US007155138B2

(12) United States Patent
Yamada

(10) Patent No.: US 7,155,138 B2
(45) Date of Patent: Dec. 26, 2006

(54) DEVELOPER SUPPLY CONTAINER

(75) Inventor: Yusuke Yamada, Moriya (JP)

(73) Assignee: Canon Kabushiki Kaisha, Tokyo (JP)

( * ) Notice: Subject to any disclaimer, the term of this patent is extended or adjusted under 35 U.S.C. 154(b) by 221 days.

(21) Appl. No.: 11/012,175

(22) Filed: Dec. 16, 2004

(65) Prior Publication Data

US 2005/0147428 A1 Jul. 7, 2005

(30) Foreign Application Priority Data

Dec. 22, 2003 (JP) ..... 2003-425721

(51) Int. Cl.
*G03G 15/08* (2006.01)

(52) U.S. Cl. ..... 399/106; 399/258; 399/262

(58) Field of Classification Search ..... 399/106, 399/258, 262
See application file for complete search history.

(56) References Cited

U.S. PATENT DOCUMENTS

| | | | | |
|---|---|---|---|---|
| 5,513,679 | A | 5/1996 | Yamada | 141/364 |
| 5,520,229 | A | 5/1996 | Yamada | 141/364 |
| 5,842,962 | A | 12/1998 | Yamada et al. | 492/18 |
| 6,137,972 | A * | 10/2000 | Playfair et al. | 399/106 |
| 6,314,261 | B1 | 11/2001 | Omata | 399/258 |
| 6,879,789 | B1 | 4/2005 | Yamada et al. | 399/106 |
| 6,952,549 | B1 * | 10/2005 | Kato et al. | 399/260 |
| 6,993,273 | B1 * | 1/2006 | Yamada | 399/258 |
| 2002/0031638 | A1 | 3/2002 | Yamada et al. | 428/99 |
| 2002/0106215 | A1 | 8/2002 | Ban et al. | 399/120 |
| 2002/0122676 | A1 | 9/2002 | Yamada et al. | 399/263 |
| 2004/0009006 | A1 | 1/2004 | Yamada et al. | 399/106 |
| 2004/0013445 | A1 | 1/2004 | Yamada et al. | 399/106 |
| 2004/0028427 | A1 | 2/2004 | Isomura et al. | 399/258 |
| 2004/0052553 | A1 | 3/2004 | Isomura et al. | 399/262 |
| 2004/0131389 | A1 | 7/2004 | Tazawa et al. | 399/258 |
| 2004/0223791 | A1 | 11/2004 | Yamada | 399/253 |
| 2005/0025529 | A1 | 2/2005 | Isomura et al. | 399/262 |
| 2005/0047818 | A1 | 3/2005 | Yamada et al. | 399/106 |
| 2005/0191094 | A1 * | 9/2005 | Kato et al. | 399/260 |

FOREIGN PATENT DOCUMENTS

| | | |
|---|---|---|
| EP | 1 089 136 A2 | 4/2001 |
| EP | 1 357 447 A2 | 10/2003 |
| EP | 1 460 487 A2 | 9/2004 |
| JP | 2002-318490 | 10/2002 |
| JP | 2003-206915 | 7/2003 |
| JP | 2003-287944 | 10/2003 |

OTHER PUBLICATIONS

Patent Abstracts of Japan, Publication No. 2002318490, Oct. 31, 2002.
Patent Abstracts of Japan, Publication No. 2003320915, Jul. 25, 2003.

* cited by examiner

*Primary Examiner*—Walter Benson
(74) *Attorney, Agent, or Firm*—Fitzpatrick, Cella, Harper & Scinto

(57) ABSTRACT

A developer supply container detachably mountable to an image forming apparatus, the developer supply container comprising a discharge opening for permitting discharging of a developer; a container body for accommodating the developer; a snap hook member having an engaging projection for snap-hook engagement with an engageable member of the image forming apparatus; a feeding portion for feeding the developer from the container toward the discharge opening by a rotating force received by the engaging projection from the engageable member; wherein snap hook member has a bending modulus of 1400–20000 MPa.

13 Claims, 18 Drawing Sheets

(a)

(b)

| | Flexural Modulus Mpa | Dimensions (mm) | | | | Ratio | | | Elastic Deformation Force N | Durability | Mounting and Demounting Defect |
|---|---|---|---|---|---|---|---|---|---|---|---|
| | | Width:b | Length:L | Height:h | Thickness:t | b/L | t/L | h/L | | | |
| Emb.1 | 1400 | 5 | 21 | 2.5 | 2 | 0.238 | 0.095 | 0.119 | 3.810 | ○ | 0% |
| Emb.2 | 2600 | 5 | 21 | 2.5 | 2 | 0.238 | 0.095 | 0.119 | 7.080 | ◎ | 0% |
| Emb.3 | 4020 | 5 | 21 | 2.5 | 2 | 0.238 | 0.095 | 0.119 | 10.950 | ◎ | 0% |
| Emb.4 | 5590 | 5 | 21 | 2.5 | 2 | 0.238 | 0.095 | 0.119 | 15.220 | ◎ | 0% |
| Emb.5 | 11000 | 5 | 21 | 2.5 | 2 | 0.238 | 0.095 | 0.119 | 29.960 | ◎ | 0% |
| Emb.6 | 20000 | 5 | 21 | 2.5 | 2 | 0.238 | 0.095 | 0.119 | 54.480 | ◎ | 0% |
| Comp.Ex.1 | 1100 | 5 | 21 | 2.5 | 2 | 0.238 | 0.095 | 0.119 | 2.990 | × | 5% |
| Comp.Ex.2 | 23000 | 5 | 21 | 2.5 | 2 | 0.238 | 0.095 | 0.119 | 62.600 | ◎ | 24% |

◎ : No deformation,No damage

○ : Very slight deformation,but no practical problem

△ : Slight deformation and crack,with non-significant practical problem

× : Large deformation and damage,with practical problem

FIG.15

| | Flexural Modulus Mpa | Dimensions (mm) | | | | Ratio | | | Elastic Deformation Force N | Durability | Mounting and Demounting Defect |
|---|---|---|---|---|---|---|---|---|---|---|---|
| | | Width:b | Length:L | Height:h | Thickness:t | b/L | t/L | h/L | | | |
| Emb.7 | 2600 | 5 | 10 | 2.5 | 2 | 0.500 | 0.200 | 0.250 | 58.000 | ◎ | 0% |
| Emb.8 | 2600 | 5 | 15 | 2.5 | 2 | 0.333 | 0.133 | 0.167 | 19.400 | ◎ | 0% |
| Emb.9 | 2600 | 5 | 25 | 2.5 | 2 | 0.200 | 0.080 | 0.100 | 4.190 | ◎ | 0% |
| Emb.10 | 2600 | 5 | 45 | 2.5 | 2 | 0.111 | 0.044 | 0.056 | 0.720 | ○ | 0% |
| Comp.Ex.3 | 2600 | 5 | 5 | 2.5 | 2 | 1.000 | 0.400 | 0.500 | 524.700 | Non-mountable | 100% |
| Comp.Ex.4 | 2600 | 5 | 50 | 2.5 | 2 | 0.100 | 0.040 | 0.050 | 0.520 | × | 0% |

◎ : No deformation,No damage

○ : Very slight deformation,but no practical problem

△ : Slight deformation and crack,with non-significant practical problem

× : Large deformation and damage,with practical problem

FIG.16

| | Flexural Modulus Mpa | Dimensions (mm) | | | | Ratio | | | Elastic Deformation Force N | Durability | Mounting and Demounting Defect |
|---|---|---|---|---|---|---|---|---|---|---|---|
| | | Width:b | Length:L | Height:h | Thickness:t | b/L | t/L | h/L | | | |
| Emb.11 | 2600 | 5 | 21 | 2.5 | 1.5 | 0.238 | 0.071 | 0.119 | 1.790 | ○ | 0% |
| Emb.12 | 2600 | 5 | 21 | 2.5 | 2 | 0.238 | 0.095 | 0.119 | 5.660 | ◎ | 0% |
| Emb.13 | 2600 | 5 | 21 | 2.5 | 2.5 | 0.238 | 0.119 | 0.119 | 11.080 | ◎ | 0% |
| Emb.14 | 2600 | 5 | 21 | 2.5 | 3 | 0.238 | 0.143 | 0.119 | 19.140 | ◎ | 0% |
| Comp.Ex.5 | 2600 | 5 | 21 | 2.5 | 1 | 0.238 | 0.048 | 0.119 | 0.700 | × | 0% |
| Comp.Ex.6 | 2600 | 5 | 21 | 2.5 | 5 | 0.238 | 0.238 | 0.119 | 88.600 | ◎ | 85% |

◎ : No deformation, No damage

○ : Very slight deformation, but no practical problem

△ : Slight deformation and crack, with non-significant practical problem

× : Large deformation and damage, with practical problem

FIG.17

| | Flexural Modulus Mpa | Dimensions (mm) | | | | Ratio | | | Elastic Deformation Force N | Durability | Mounting and Demounting Defect |
|---|---|---|---|---|---|---|---|---|---|---|---|
| | | Width:b | Length:L | Height:h | Thickness:t | b/L | t/L | h/L | | | |
| Emb.15 | 2600 | 5 | 21 | 2.5 | 2 | 0.238 | 0.095 | 0.119 | 7.080 | ◎ | 0% |
| Emb.16 | 2600 | 5 | 21 | 1 | 2 | 0.238 | 0.095 | 0.048 | 2.830 | ◎ | 0% |
| Emb.17 | 2600 | 5 | 21 | 4 | 2 | 0.238 | 0.095 | 0.190 | 11.300 | ◎ | 0% |
| Emb.18 | 2600 | 5 | 21 | 5 | 2 | 0.238 | 0.095 | 0.238 | 14.160 | ◎ | 0% |
| Comp.Ex.7 | 2600 | 5 | 21 | 0.5 | 2 | 0.238 | 0.095 | 0.024 | 1.410 | Lost motion | 64% |
| Comp.Ex.8 | 2600 | 5 | 10 | 5 | 2 | 0.500 | 0.200 | 0.500 | 131.100 | Non-mountable | 100% |

◎ : No deformation,No damage

○ : Very slight deformation,but no practical problem

△ : Slight deformation and crack,with non-significant practical problem

× : Large deformation and damage,with practical problem

FIG.18

DEVELOPER SUPPLY CONTAINER

FIELD OF THE INVENTION AND RELATED ART

The present invention relates to a developer supply container used by an image forming apparatus such as a copying machine, a printer, a facsimileing machine, a multifunction apparatus capable of performing two or more functions of the preceding image forming apparatuses, etc.

Particulate toner has long been used as the developer for an electrostatic image forming apparatus such as an electrophotographic copying machine, a printer, etc. It has been common practice to use a toner supply container to supply the main assembly of an electrophotographic image forming apparatus with toner, as the toner in the main assembly of an electrophotographic image forming apparatus is depleted of toner by consumption.

Here, an electrophotographic image forming apparatus means an apparatus which forms an image on recording medium with the use of an electrophotographic image forming method. It includes an electrophotographic copying machine, an electrophotographic printer (for example, laser beam printer, LED printer, etc.), a facsimileing machine, a wordprocessor, etc.

Toner is in the form of extremely small particulate. Therefore, toner is likely to scatter when supplying the main assembly of an image forming apparatus with it. Thus, a method in which a toner supply container is placed in the main assembly to prevent toner from scattering, and toner is discharged from the toner supply container little by little through a small opening has been known.

All of the toner supply containers for those apparatuses described above are structured so that they are driven by some means or other from the main assembly side of an image forming apparatus. As they receive driving force from the main assembly side, the convey member or container proper on the toner supply container side is driven to discharge toner from them.

An example of such toner supply containers is disclosed in Japanese Laid-open Patent Application 2002-318490. The toner supply container disclosed in this patent application comprises a cylindrical main structure, or container proper, and a toner outlet. The toner outlet is smaller in diameter than the container proper, and projects from the container proper. It is fitted with a sealing member removably attachable to the toner outlet to seal or unseal the toner outlet. The toner supply container is structured so that as it receives rotational driving force from the main assembly of an image forming apparatus, the container proper rotates to discharge toner little by little from the toner outlet to supply the main assembly with toner as necessary.

This toner supply container is characterized in that the rotational driving force from the main assembly of an image forming apparatus is transmitted to the container proper through the sealing member attached to one of the lengthwise ends of the toner supply container. In other words, not only is this sealing member given the function of keeping the toner outlet sealed, but also, the function of the coupling for receiving the rotational force from the main assembly of an image forming apparatus.

More specifically, as the main front cover of the main assembly of an image forming apparatus is closed after the placement of the toner supply container in the main assembly, the toner supply container is engaged with the driving portion of the main assembly by the closing movement of the main cover. Then, the sealing member is partially separated from the toner outlet, unsealing the toner supply container, and the container proper is rotationally driven by the force transmitted through the sealing member.

Giving all the functions necessary to supply the main assembly of an image forming apparatus with toner, that is, the functions of "coupling", "sealing and unsealing", and "driving", to a single component, that is, the sealing member, makes it possible to integrate the mechanism for opening or closing the cap of the toner supply container, with the mechanism for rotationally driving the toner supply container, on the main assembly side of the image forming apparatus, not only making it therefore possible to reduce in size the main assembly of the image forming apparatus, but also, improving the image forming apparatus in usability.

The sealing member disclosed in Japanese Laid-open Patent Application 2002-318490 is provided with a coupling which snap-fits with the driving portion of the main assembly of an image forming apparatus, in order to improve the sealing member in terms of the above described functions.

The snap-fitting portion of this coupling is structured so that as it is engaged with the driving portion of the main assembly of an image forming apparatus, it partially separates the sealing member from the toner outlet of the container proper of the toner supply container, unsealing thereby the toner supply container (toner outlet). After partially separating the sealing member from the toner outlet, it remains engaged with the driving portion of the main assembly to receive the rotational force from the main assembly and transmit it to the container proper of the toner supply container.

The snap-fitting portion of a sealing member such as the above described one which is formed of elastic material to utilize the elasticity of the material is given not only the function of "coupling", but also, the function of receiving (and transmitting) the rotational driving force.

However, in spite of being excellent in structure as described, the toner supply container disclosed in Japanese Laid-open Patent Application 2002-318490 is problematic in that it may suffer from the following problems because of the properties of the substance used as the material for the snap-fitting portion of the sealing member.

That is, if a substance low in "flexural elastic modulus", that is, the value representing one of the mechanical properties of a substance, is used as the material for the snap-fitting portion of a sealing member, it is possible that as the snap-fitting portion receives the rotational driving force from the main assembly of an image forming apparatus, it will break, or will be reduced in durability, allowing that the snap-fitting portion will be smaller in the amount of force necessary to make the snap-fitting portion snap-fitted with the driving portion of the main assembly.

On the other hand, if a substance high in flexural elastic modulus is used as the material for the snap-fitting portion of a sealing member, it is possible that the force necessary for the snap-fitting portion to be snap-fitted (made to overlap) with the driving portion of the main assembly will be substantial, allowing that there will be little possibility that as the snap-fitting portion receives the rotational driving force from the main assembly of an image forming apparatus, it will break, or will be reduced in durability. The amount of the increase in the force necessary for the snap-fitting portion of a sealing member to be snap-fitted with the main assembly of the image forming apparatus assembly leads to the decrease in the usability of an image forming apparatus, which is not a thing to be mentioned in favorable terms, in particular, if an image forming apparatus is structured so that the snap-fitting portion of a sealing member is to be engaged with the driving portion of the main assembly by a user.

SUMMARY OF THE INVENTION

Thus, the primary object of the present invention is to provide a developer supply container having a snap-fitting member satisfactory not only in terms of the function of snap-fitting with the snap-fitting portion of the main assembly of an image forming apparatus, but also, in terms of the function of receiving rotational driving force from the snap-fitting portion of the main assembly.

These and other objects, features, and advantages of the present invention will become more apparent upon consideration of the following description of the preferred embodiments of the present invention, taken in conjunction with the accompanying drawings.

BRIEF DESCRIPTION OF THE DRAWINGS

FIG. 15 is a table giving the results of the test in which the effects of the flexural elastic modulus of the material for the sealing member upon the performance of the sealing member were studied.

FIG. 16 is a table giving the results of the test in which the effects of the relationship between the width b and length L of the snap-fitting portion of the sealing member upon the performance of the sealing member were studied.

FIG. 17 is a table giving the results of the test in which the effects of the relationships between the thickness t and length L of the snap fitting portion of the sealing member upon the performance of the sealing member were studied.

FIG. 18 is a table giving the results of the test in which the effects of the relationship between the height h and length L of the snap fitting portion of the sealing member upon the performance of the sealing member were studied.

DETAILED DESCRIPTION OF THE PREFERRED EMBODIMENTS

Hereinafter, the preferable embodiments of the sealing member and developer supply container in accordance with the present invention will be described in detail with reference to the appended drawings.

Figure 1:
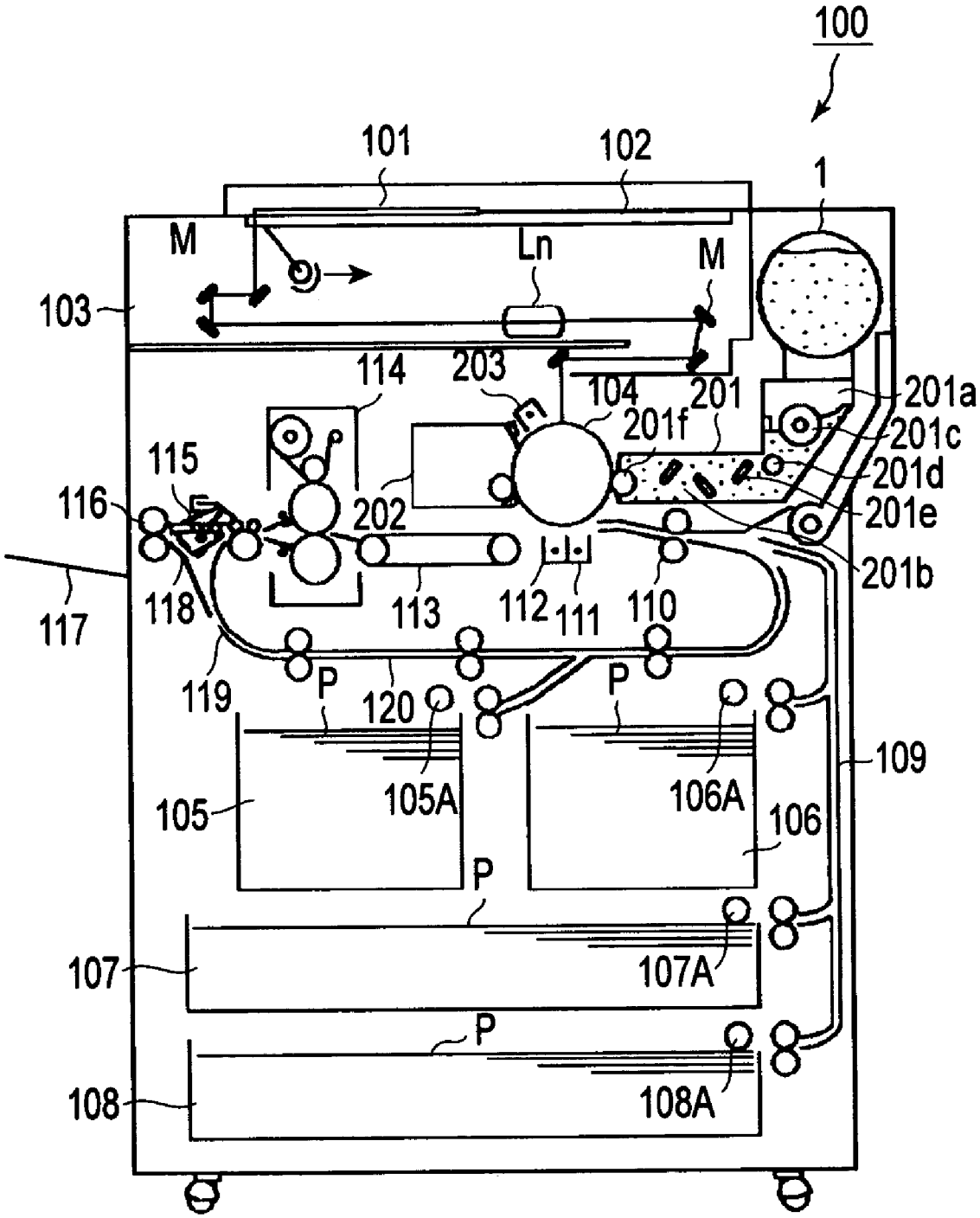
FIG. 1 is a sectional view of an example of an image forming apparatus in accordance with the present invention.

First, referring to FIG. 1, an example of an electrophotographic image forming apparatus in which a toner supply container, as a developer supply container, which is equipped with the sealing member in accordance with the present invention will be described regarding its structure.

[Electrophotographic Image Forming Apparatus]

As an original 101 is placed on the original placement glass platen 102 of the main assembly of the electrophotographic copying machine 100 (which hereinafter will be referred to simply as "apparatus main assembly"), an optical image reflecting the image formation data of the original 101 is formed on the electrophotographic photosensitive drum 104 (which hereinafter will be referred to as "photosensitive drum") as an image bearing member by a plurality of mirrors M and lenses Ln of the optical portion 103 of the main assembly. Designated by referential numbers 105–108 are cassettes, from among which the cassette containing recording mediums (which hereinafter may be referred to simply as papers) P, which agree in size with the information inputted by an operator through the control panel 100*a*, or are most suitable to the size of the original 101, is selected, based on the information regarding the sizes of the papers in the cassettes 105–108. The recording medium does not need to be limited to paper. For example, an OHP sheet or the like may be used as necessary.

The papers P are conveyed one by one by separating and conveying apparatuses 105A–108A, to a pair of registration rollers 110 by way of a paper conveyance path 109. Then, each paper P is conveyed further by the pair of registration rollers 110 in synchronism with the rotation of the photosensitive drum 104 and the scanning timing of the optical portion 103. In the transfer station, the toner image formed on the photosensitive drum 104 is transferred onto the paper P by a transfer discharging device 111. Then, the paper P on which the toner image has just been transferred is separated from the photosensitive drum 104 by the separation discharge device 112.

Thereafter, the paper P is further conveyed by a paper conveying portion 113 to the fixation station 114, in which the toner image on the paper P is fixed by heat and pressure. Then, when the copying machine is in the single-sided print mode, the paper P is moved through the reversing station 115, without being placed upside down, and is discharged into the delivery tray 117 by a pair of discharge rollers 116. When the machine is in the two-sided print mode, the flapper 118 of the reversing station 115 is controlled so that the paper P is conveyed to the pair of registration rollers 110 by way of re-feeding conveyance paths 119 and 120. Then, the paper P is made to move through the same paths as those through which the paper P is moved when the machine is in the single-sided print mode, and is discharged into the delivery tray 117.

When the machine is in the multilayer print mode, the paper P is sent through the reversing station 115 so that it is stopped after it is partially extended outward from the main assembly by the pair of discharge rollers 116. More specifically, it is stopped immediately after the trailing edge of the paper P is moved past the flapper 118, while the paper P is remaining pinched by the pair of discharge roller 116. Then, the flapper 118 is switched in position, and the pair of discharge rollers 116 are rotated in reverse so that the paper P is conveyed back into the main assembly. Thereafter, the paper P is conveyed to the registration rollers 110 through paper re-conveyance paths 119 and 120. Then, it is moved through the same paths as those through which it is moved when the machine is in the single-side print mode, and discharged into the delivery tray 117.

In the main assembly 100 of the copying machine structured as described above, the developing apparatus 201, cleaning apparatus 202, primary charging device 203, etc., are disposed in the adjacencies of the peripheral surface of the drum 104.

The developing apparatus 201 is an apparatus for developing, with the use of developer, the electrostatic latent image formed on the peripheral surface of the drum 104 by exposing the uniformly charged peripheral surface of the photosensitive drum 10 by the optical station 103, based on the image formation data extracted from the original 101. The toner supply container 1 for supplying this developing apparatus 201 with toner as developer is to be removably mounted in the main assembly 100 of the copying machine by a user. Incidentally, not only is the present invention is compatible with a toner supply container for supplying the main apparatus of an image forming apparatus with pure toner, but also, with a toner supply container for supplying the apparatus main assembly with a mixture of toner and carrier. This embodiment, however, will be described with reference to the former container.

The developing apparatus 210 comprises a toner hopper 201*a* as a toner storing means, and a developing device 201*b*. The toner hopper 201*a* is provided with a stirring member 201*c* for stirring the toner supplied from the toner supply container 1. After being stirred by the stirring member 201*c*, the toner supplied from the toner supply container 1 is sent to the developing device 201*b* by a magnetic roller 201*d*. The developing device 201*b* comprises a development roller 201*f* and a toner forwarding member 201*e*. After being sent from the toner hopper 201*a* by the magnetic roller 201*d*, the toner is sent to the development roller 201*f* by the toner forwarding member 201*e*, and then, is supplied to the photosensitive drum 104 by the development roller 201*f*.

The cleaning apparatus 202 is for removing the toner remaining on the peripheral surface of the photosensitive drum 104. The primary charger 203 is for charging the photosensitive drum 104.

Figure 2:
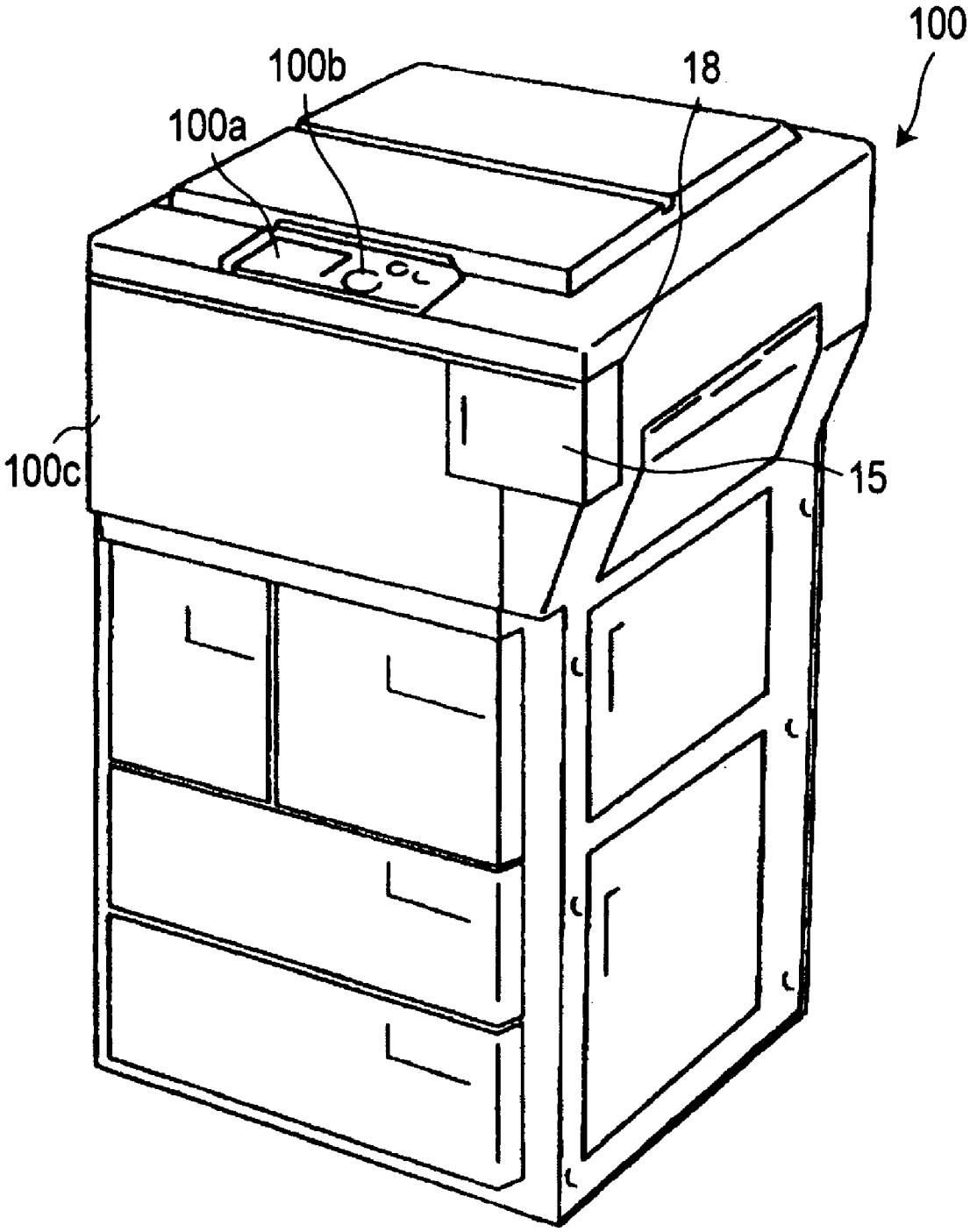
FIG. 2 is a perspective view of the image forming apparatus shown in FIG. 1.
Figure 3:
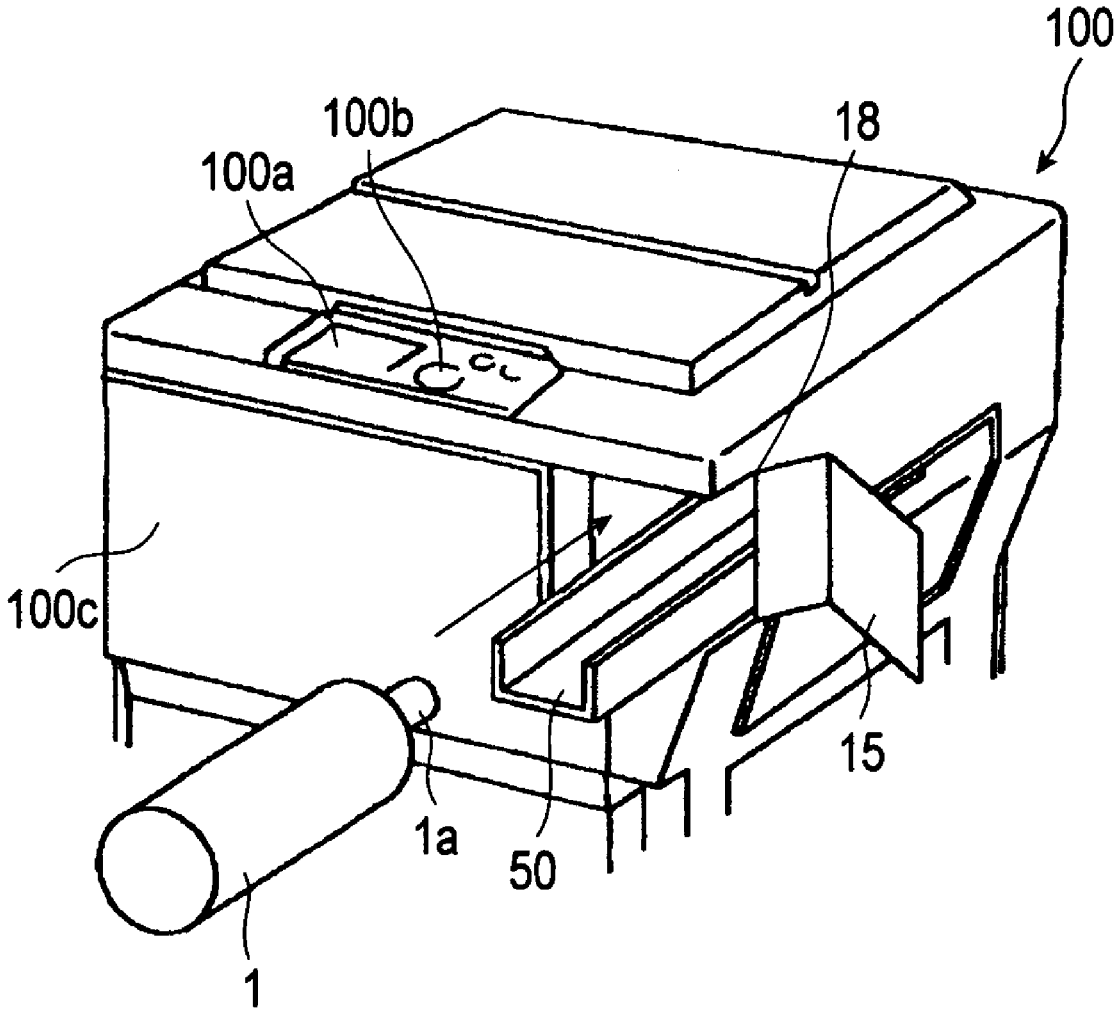
FIG. 3 is a perspective view of the top portion of the image forming apparatus shown in FIG. 1, showing the procedure for mounting a toner supply container into the image forming apparatus.

Referring to FIGS. 2 and 3, as the front cover 15 for the replacement of a toner supply container (which hereinafter will be referred to as "exchange cover"), which constitutes a part of the external shell of the main assembly 100, is opened as shown in FIG. 3, a toner supply container tray 50, which is a part of the toner supply container mounting means, is pulled out by a driving system (unshown) to a predetermined location. The user is to place the toner supply container 1 on the container tray 50. When necessary to remove the toner supply container 1 from the apparatus main assembly 100, the user is to pull out the container tray 50, and remove the toner supply container 1 from the container tray 50. The toner replenishment front cover is a cover dedicated to the operation for mounting or dismounting (exchanging) the toner supply container 1; it is opened or closed only for mounting or dismounting the toner supply container 1. For the maintenance of the apparatus main assembly, the front cover 100*c* is to be opened.

The apparatus main assembly 100 may be structured without the container tray 50 so that the toner supply container 1 can be directly mounting into, or removed from, the apparatus main assembly 100.

[Process of Supplying Apparatus Main Assembly With Toner]

Figure 4:
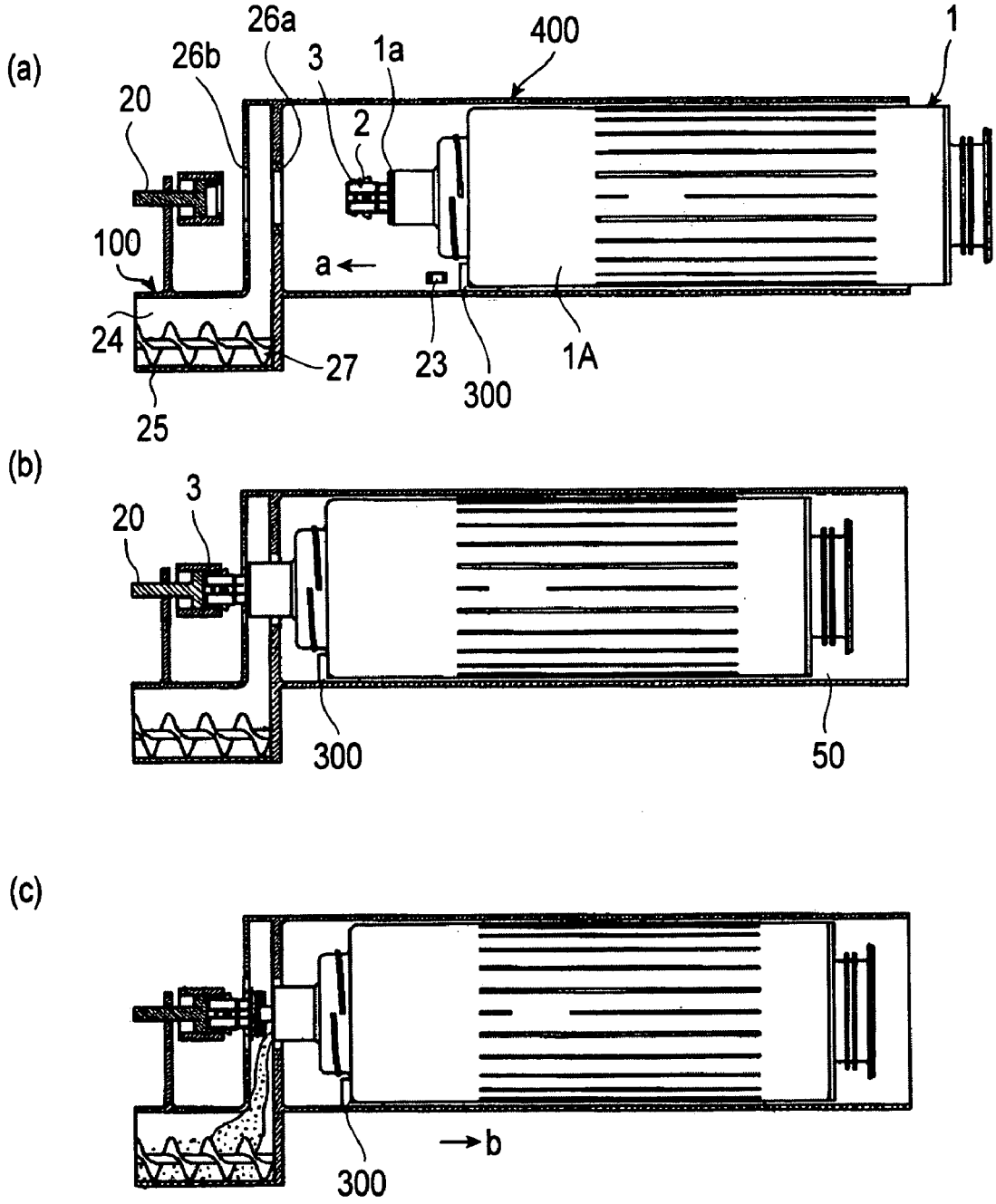
FIGS. 4(*a*), 4(*b*), and 4(*c*) are sectional views of the toner supply container, showing the working of the container at the beginning of the mounting of the toner supply container, during the mounting, and at the completion of the mounting, respectively.

First, referring to FIGS. 4(*a*)–4(*c*), the process of supplying the apparatus main assembly 100 with toner with the use of the toner supply container 1 (which hereinafter may be referred to as "toner bottle") will be described. FIGS. 4(*a*)–4(*c*) show distinctive stages of the process in which the toner bottle 1 is inserted into the apparatus main assembly 100 and the apparatus main assembly 100 is supplied with the toner from the toner bottle 1.

As shown in FIG. 4, the apparatus main assembly 100 is provided with a toner supplying apparatus 400, and the toner supplying apparatus 400 is provided with a driving portion 20 (coupling) as a connector which engages with the toner bottle 1 to rotationally drive the toner bottle 1. The driving portion 20 is rotatably supported by an unshown bearing, and is structured so that it is rotationally driven by an unshown motor disposed in the apparatus main assembly 100.

The apparatus main assembly 100 is provided with a partition wall 25, which constitutes a part of the toner supply passage 24 leading to the toner hopper 201*a*, and to which inward and outward bearings 26*a* and 26*b*, which also seal the toner supply passage 24, are firmly attached. The apparatus main assembly 100 is also provided with a screw 27, which is disposed in the toner supply passage 24 to convey the supplied toner to the hopper 201*a*.

FIG. 4(*a*) shows the initial stage of the insertion of the toner bottle 1 into the apparatus main assembly 100. The toner bottle 1 is provided with a cylindrical toner outlet la (which hereinafter may be referred to simply as "outlet"), which is located at one of the lengthwise ends of the toner bottle 1. In the stage shown in FIG. 4(*a*), the opening of the outlet is sealed with a sealing member 2.

As the toner bottle 1 is further inserted, the snap-fitting portion as a snap-and-hook portion, that is, the end portion, of the sealing member 2 enters the driving portion 20 of the apparatus main assembly 100 in such a manner that the snap-fitting portion of the sealing member overlaps with the cylindrical wall of the driving portion 20. As a result, a latching projection 3 of the end portion of the snap-fitting portion snaps into the catching hole of the driving portion 20, preventing thereby the sealing member from disengaging from the driving portion 20. FIG. 4(*b*) shows the stage of the insertion of the toner bottle 1 immediately after the engagement of the snap-fitting portion with the driving portion 20.

The engagement between the driving portion and snap-fitting portion occurs in the following manner: As a user inserts the toner bottle 1, the driving portion 20 comes into contact with the top surface (pressure receiving portion) of the latching projection 3, and then, as the user inserts the toner bottle 1 deeper, the latching projection 3 is pressed down (displaced toward axial line of sealing member) by the driving portion 20. Then, as the toner bottle 1 is inserted even deeper by the user, the latching projection 3 is relieved of the downward pressure from the driving portion 20, allowing the snap-fitting portion (portion which supports latching projection 3) to recover by its own resiliency, moving thereby the latching projection 3 back into the original position in terms of the radius direction of the sealing member. As a result the sealing member becomes securely engaged with the driving portion. In other words, in this embodiment, the so-called "snap-fitting system" is employed as the means for coupling the sealing member of the toner supply container 1 with the driving portion of the apparatus main assembly 100.

After the engagement between the sealing member 2 and driving portion 20, the surface 3*b*, as the surface by which the latching projection 3 engages with the driving portion, which is perpendicular to the thrust direction (perpendicular to axial line of sealing member), remains in contact with the internal surface of the latching projection catching hole of the driving portion 20. Therefore, the sealing member 2 remains locked (presence of slight play is permissible) with the driving portion 20 unless this engagement between the surface 3*b* and the internal surface of the latching projection catching hole is dissolved.

After the completion of the coupling of the snap-fitting portion of sealing member 2 with the driving portion 20, the toner bottle exchange front cover 15 is closed. As the cover 15 is closed, the sliding member 300 is retracted in the direction indicated by an arrow mark b by the movement of the cover 15, causing the toner bottle 1 to moved backward. However, the sealing member 2 is locked with the driving portion 20 of the apparatus main assembly 100. Therefore, the sealing member 2 is moved in the direction to be separated from the toner bottle 1 in relative terms. As a result, the outlet 1*a* is unsealed, making it thereby possible for the toner in the toner bottle 1 to be supplied to the apparatus main assembly 100, as shown in FIG. 4(*c*).

Then, an unshown motor in the apparatus main assembly 100 is started. As the motor is started, the rotational driving force from the motor is transmitted to the driving force receiving surface 3*a*, as driving force receiving portion, of the latching projection 3 of the sealing member 2 through the driving portion 20 of the apparatus main assembly 100, and is transmitted further to the toner bottle 1 from the sealing member 2. As a result, the toner bottle 1 is rotated, conveying thereby the toner therein and discharging it. In other words, the snap-fitting portion of the sealing member 2 has the function of unsealing (or resealing) the toner outlet 1*a*, and also, the function of transmitting the rotational driving force from the main assembly side of the image forming apparatus to the toner bottle side.

The toner bottle 1 is rotatably supported by the bottle supporting rollers 23 of the toner bottle tray 50. Therefore, it can be smoothly rotated by a very small amount of torque. There are four bottle supporting rollers 23, which are optimally distributed for the bottle proper 1A of the toner bottle 1 to saddle. The bottle supporting rollers 23 are rotatably attached to the toner supplying apparatus 400 of the apparatus main assembly 100. As the toner bottle 1 is rotated as described above, the toner in the toner bottle 1 is gradually discharged through the outlet 1*a* into the toner supply passage 24, and is conveyed to the hopper 201*a* of the apparatus main assembly 100 by the screw 27 located in the toner supply passage 24; in other words, the apparatus main assembly 100 is supplied with toner.

[Method for Exchanging Toner Supply Container]

Next, the method for exchanging the toner bottle in accordance with the present invention will be described.

As virtually the entirety of the toner in the toner bottle 1 is consumed by image formation, it is detected by a detecting means (unshown) of the apparatus main assembly 100 for detecting whether or not the toner bottle 1 is empty, that the toner bottle 1 is depleted of toner, a user is given this information through a displaying means 100*b* (FIG. 2) such as an LCD.

Figure 5:
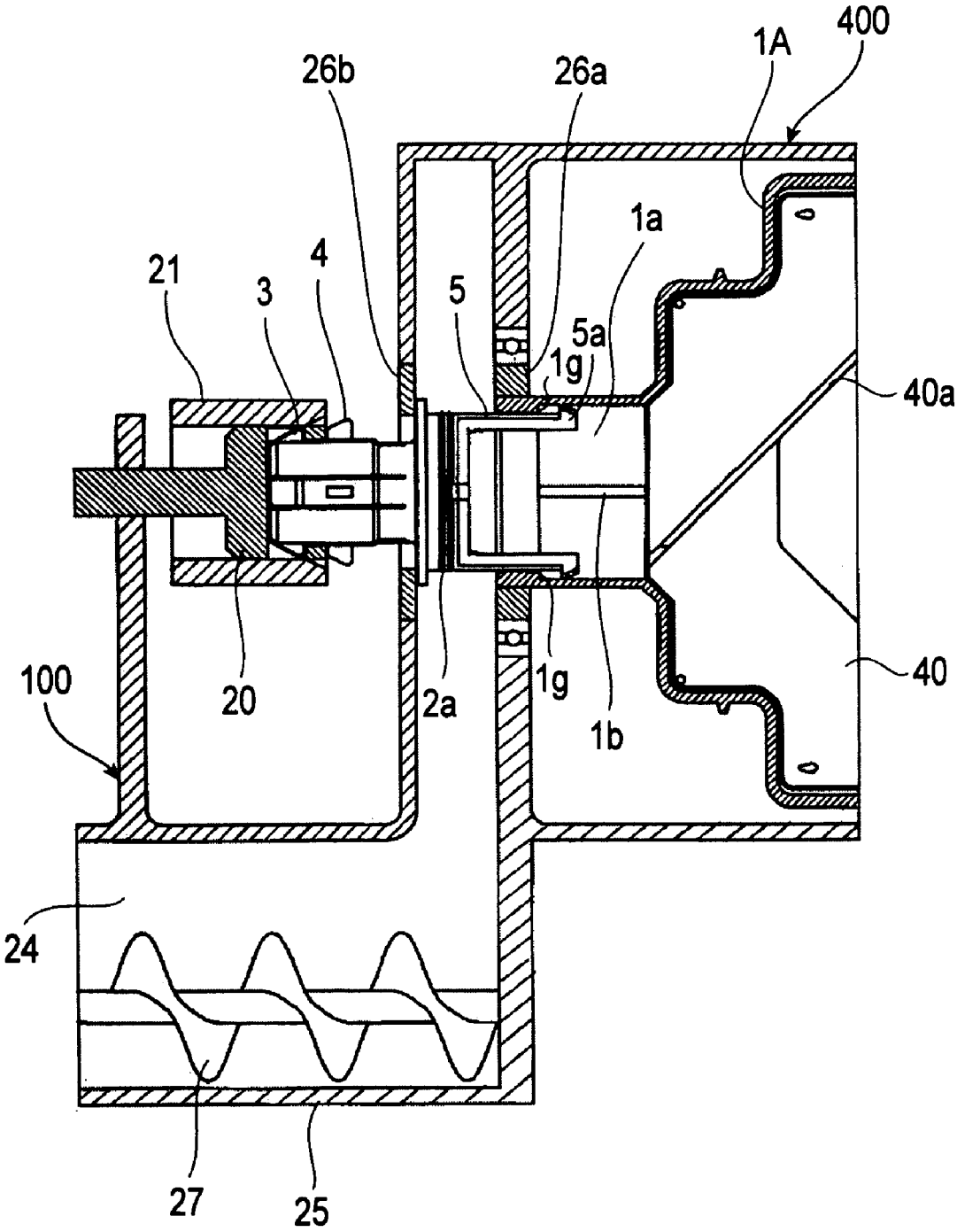
FIG. 5 is an enlarged view of the snap-fitting portions of the sealing member and main assembly of the image forming apparatus from FIG. 4.

The toner bottle 1 in this embodiment is to be exchanged by a user himself. The procedure for exchanging the toner bottle 1 is as follows:

First, a user is to rotate the closed toner bottle exchange front cover 15 about the hinge 18 to open it as shown in FIG. 2. As the toner bottle exchange front cover 15 is opened, the bottle proper 1A, which is in the state shown in FIG. 4(*c*), is moved in the direction indicated by the arrow mark a in FIG. 4(*a*), which is opposite to the direction indicated by the arrow mark b in FIG. 4(*c*), by an unshown toner supplying portion moving (opening or closing) means, which is moved by the movement of the toner bottle exchange front cover 15. As a result, the sealing member 2, which has remained partially separated from the bottle proper 1A, having therefore left the toner outlet 1*a* open, is pressed into the toner outlet 1*a*, resealing thereby the toner outlet 1*a*, as shown in FIG. 4(*b*). In this state, the sealing member 2 still remains locked with the main assembly 100. Then, as pressure is applied to the unlatching projection 4 by the releasing member 21 (FIG. 5), which will be described later, the latching projection 3 is pressed down together with the unlatching projection 4, freeing thereby the sealing member 2 from the driving portion 20, making it possible for the bottle proper 1A to be moved backward. Then, as the toner bottle 1 is pulled backward, the procedure for disengaging the sealing member 2 from the apparatus main assembly 100 is completed.

Next, the user is to pull out the empty toner bottle 1 disengaged from the apparatus main assembly 100, in the opposite direction from the direction indicated by the arrow mark a in FIG. 4(*a*), that is, the direction indicated by the arrow mark b in FIG. 4(*c*), from the apparatus main assembly 100. Next, the user is to insert a new toner bottle 1 into the apparatus main assembly 100 in the direction indicated by the arrow mark a in FIG. 4(*a*), and to close the toner bottle exchange front cover 15. As the toner bottle exchange front cover 15 is closed, the sealing member 2 of the new toner bottle, which has just been engaged with the apparatus main assembly 100, is partially separated from the bottle proper 1A, unsealing thereby toner outlet 1*a* (FIG. 4(*c*)). The above is the procedure for exchanging the toner supply container 1.

[Toner Bottle]

Figure 6:
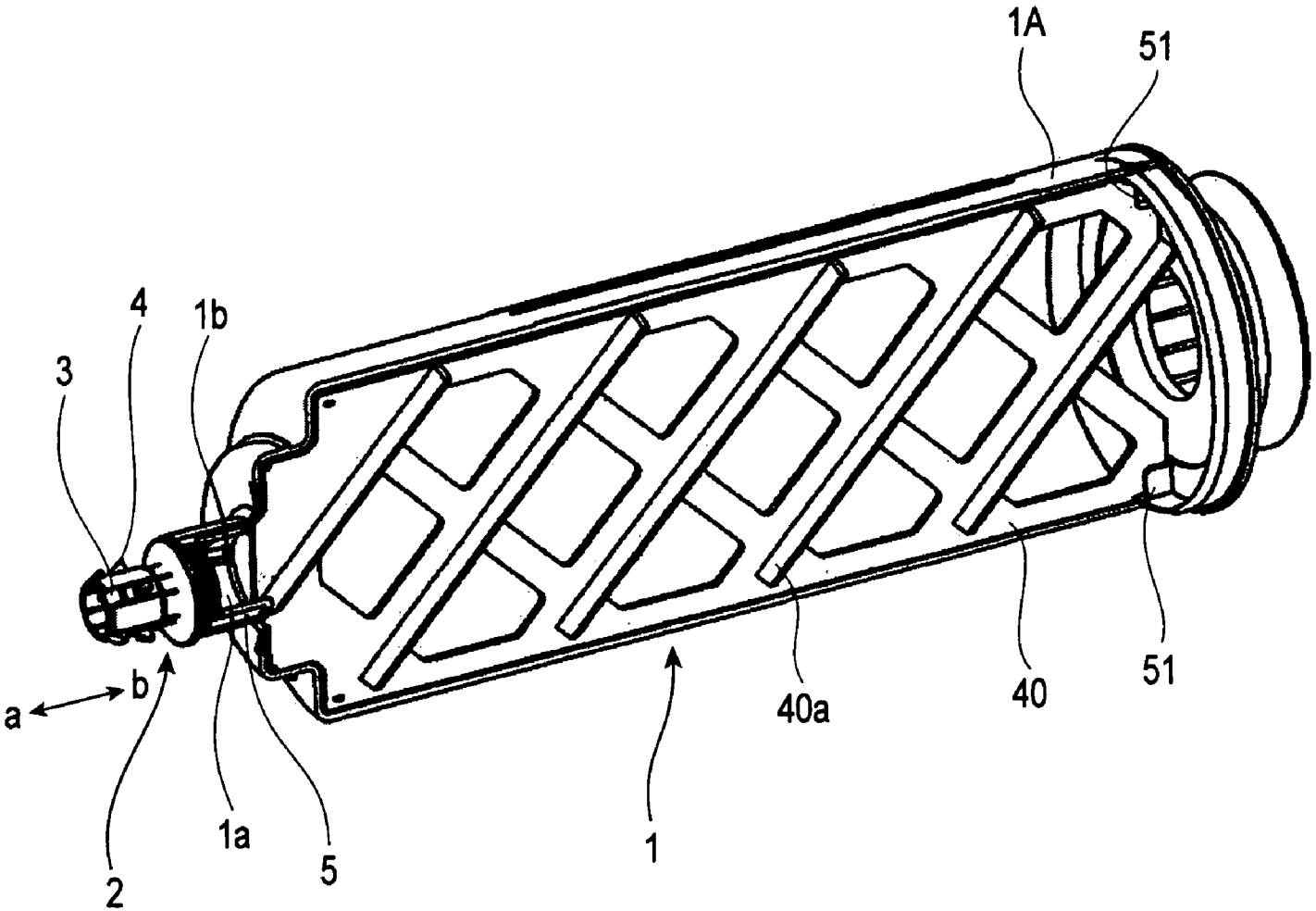
FIG. 6 is a partially broken perspective view of the toner supply container in accordance with the present invention.

Next, referring to FIGS. 6 and 7, the developer supply container 1 in this embodiment will be described. The developer supply container 1 is roughly cylindrical. It has the toner outlet 1*a*, as a toner discharging port, which is attached to the approximate center of the one of the end surfaces of the container proper (bottle proper). The toner outlet 1*a* is smaller in diameter than the cylindrical bottle proper 1A. The outlet 1*a* is fitted with the sealing member 2, which seals or unseals the outlet 1*a*. As will have been understood through the description given above with reference to FIGS. 4(*a*)–4(*c*), the outlet 1*a* and sealing member 2 are structured so that as the sealing member 2 is slid relative to the outlet 1*a* in the lengthwise direction (direction indicated by arrow mark aor b) of the developer supply container 1, the outlet 1*a* is automatically sealed or unsealed.

The opposite end portion of the sealing member 2 from the container proper 1A is cylindrical, and is provided with the unlatching projections 4 for unlocking the latching projections 3 from the driving portion 20 of the apparatus main assembly 100. This cylindrical end portion, which supports the these latching projections 3 and unlatching projections 4, is structured so that it is allowed to elastically deform (it is provided with slits which extend from its tip to base portion, in order to make it easier for its projection supporting portions to elastically deform; this will be described later). Each of these lo latching projections 3 is structured so that it latches with the driving portion 20 of the apparatus main assembly 100 to transmit to the developer supply container 1 the driving force from the apparatus main assembly 100. The structure of the latching projection 3 of the sealing member 2 will be described later in detail.

First, referring to FIG. 6, the internal structure of the developer supply container 1 will be described. As described above, the developer supply container 1 has a roughly cylindrical shape. It is roughly horizontally placed in the apparatus main assembly 100, and is structured so that as it receives driving force from the apparatus main assembly 100, it rotates.

There is a baffling member 40 as a toner conveying member in the bottle proper 1A of the toner bottle 1. It is in the form of a plate, and is firmly attached to the internal walls of the bottle proper 1A, in such a manner that it is virtually impossible for the baffling member 40 to rotating relative to the bottle proper 1A. The baffling member 40 is provided with a plurality of ribs, which are attached to both surfaces of the baffling member 40, being angled relative to the direction of the rotational axis of the developer supply container 1. The slanted rib 40*a*, which is closest to the toner outlet 1*a*, is in contact with the toner outlet 1*a* by one end.

The developer supply container 1 is structured so that the toner therein is conveyed by the baffling member 40 toward the outlet 1*a*, and finally, is discharged from the developer supply container 1 through the outlet 1*a* by being assisted by the slanted rib 40*a* closest to the outlet 1*a*.

As for the principle of toner discharge, as the developer supply container 1 is rotated by the rotational force which the snap-fitting portion receives, the toner in the developer supply container 1 is scooped upward by the baffling member 40, and then, slides down on the surfaces of the baffling member 40 while being guided forward (toward the toner outlet 1*a*) of the slanted ribs 40*a*. Since the developer supply container 1 is continuously rotated, the above described process of being scooped up and sliding down is repeated by the toner. As a result, the toner is gradually conveyed toward the outlet 1*a* while being stirred, and then, is discharged through the outlet 1*a*. The baffling member 40 in the form of a plate is formed independently from the container proper 1A of the developer supply container 1, and is anchored to the container proper 1A by the anchoring ribs 51 so that it will rotate with the container proper 1A.

The internal structure of the developer supply container 1 in accordance with the present invention does not need to be limited to the above described one. In other words, the internal structural arrangement for the developer supply container 1, and the shapes of the internal components of the developer supply container 1, are optional, as long as the toner in the developer supply container 1 is discharged from the developer supply container 1 as the developer supply container 1 receives driving force from the main assembly of an image forming apparatus.

For example, instead of the above described structural arrangement, the container proper 1A of the developer supply container 1 may be placed in the main assembly of an image forming apparatus so that it is virtually impossible for the developer supply container 1 to be rotated. In this case, the toner supply container is structured so that the rotational driving force which the snap-fitting portion receives from the driving portion of the apparatus main assembly is transmitted to the rotatable screw, or the like, as a toner conveying member, disposed in the container proper 1A. In other words, as far as the internal structure of the developer supply container 1 is concerned, the toner conveying portion may be in the form of the above described baffling member, or a member different in structure from the above described baffling member.

Figure 7:
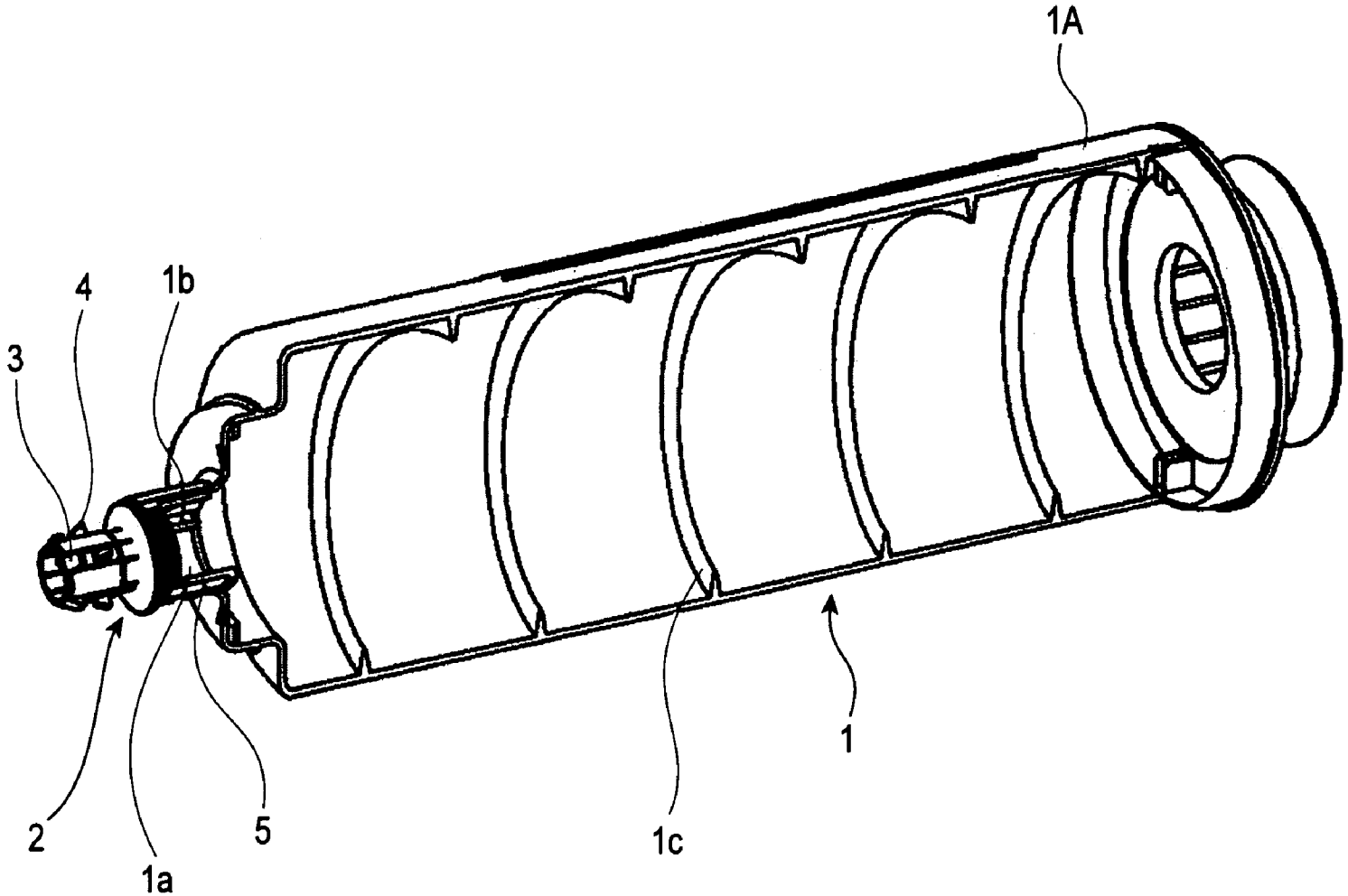
FIG. 7 is a partially broken perspective view of one of the modified versions of the toner supply container in accordance with the present invention.

For example, the internal structure of the bottle proper 1A of the toner bottle 1 may be as shown in FIG. 7, which shows one of the modified versions of this embodiment. In this modified version, the toner bottle 1 is in the form of the so-called spiral bottle. The toner bottle 1 is provided with a spiral rib 1*c*, as a toner conveying member, which is attached to the internal surface of the cylindrical bottle proper 1A. Thus, as the toner supply container 1 rotates, the toner is conveyed by the spiral rib 1*c* in the direction parallel to the axial line of the container proper 1A, and then, is discharged from the toner supply container 1 through the outlet 1*a* attached to one of the end surfaces of the container proper 1A.

Next, referring to FIG. 8, the bottle proper 1A of the toner bottle 1 will be described. The bottle proper 1A is provided with the toner outlet 1*a*, which is attached to one of the lengthwise ends thereof. There is a driving force receiving portion 1*b* in the toner outlet 1*a*. The driving force receiving portion 1*b* is an integral part of the bottle proper 1A. The driving force receiving portion 1*b* receives the driving force from the driving force transmitting portion 5 of the sealing member 2, and rotates the bottle proper 1*a*. The toner outlet 1*a* of the toner bottle 1 in this embodiment is provided with a pair of driving force receiving portions 1*b*, which are disposed in a manner to oppose each other. However, the position, number, shape, measurements (height, length, etc.) of the driving force receiving portion 1*b* is optional; they are not specifically limited.

Figure 8:
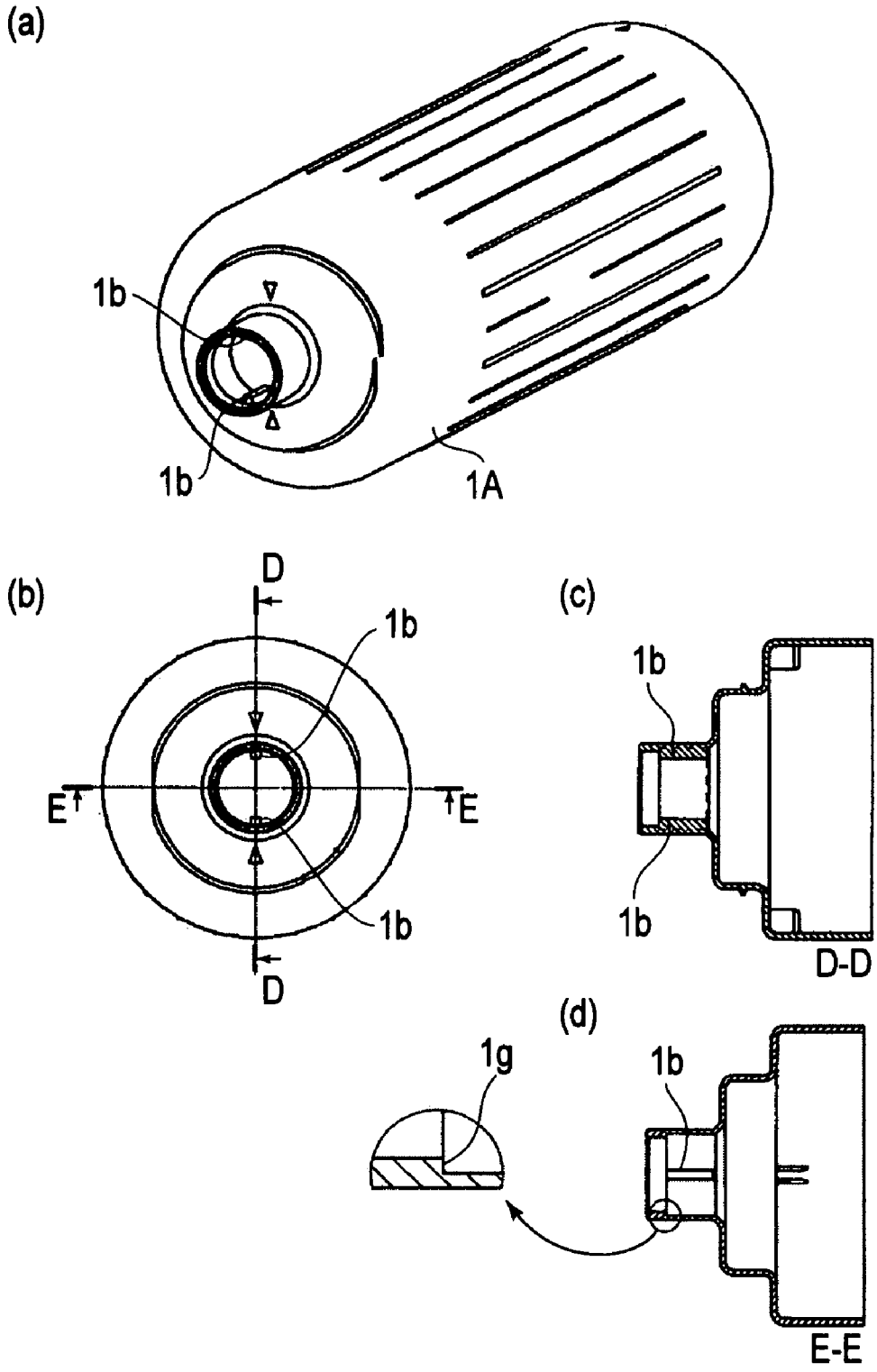
FIGS. 8(*a*), 8(*b*), 8(*c*), and 8(*d*) are a perspective view, a front view, sectional view at the line D—D in 8(*b*), and a sectional view at the line E—E in 8(*b*), of the container proper of the toner supply container in accordance with the present invention.

As depicted in detail in FIG. 8, the toner outlet 1*a* has two portions different in wall thickness, having therefore a surface 1*g* comparable to the riser portion of a stair step. This surface 1*g* comes into contact with the surface 5*b* of the driving force transmitting portion 5 to regulate the amount by which the sealing member 2 is allowed to slide outward. The driving force transmitting portion 5 will be described later.

[Sealing Member]

Next, referring to FIGS. 9–11, the structure of the sealing member 2 which best characterizes the present invention will be described further.

Figure 9:
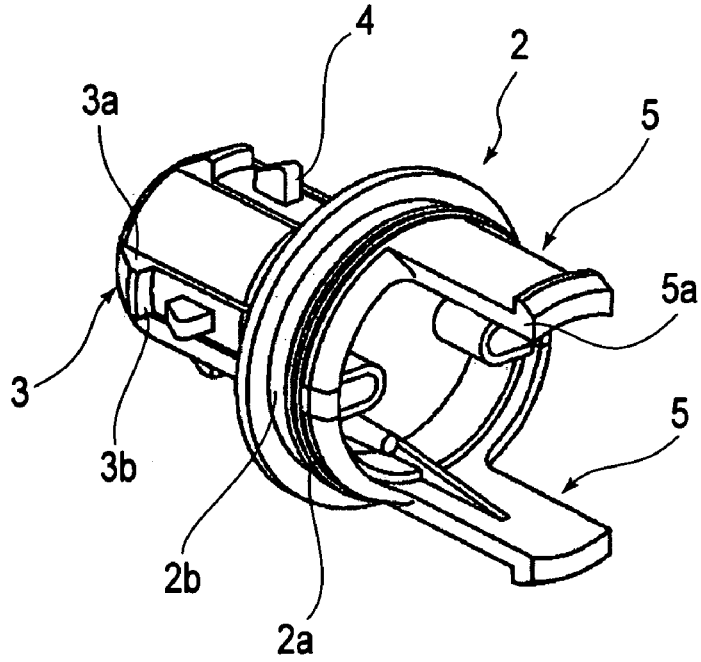
FIGS. 9(*a*) and 9(*b*) are perspective views of the sealing member in accordance with the present invention, as seen from the right and left sides thereof.
Figure 9:
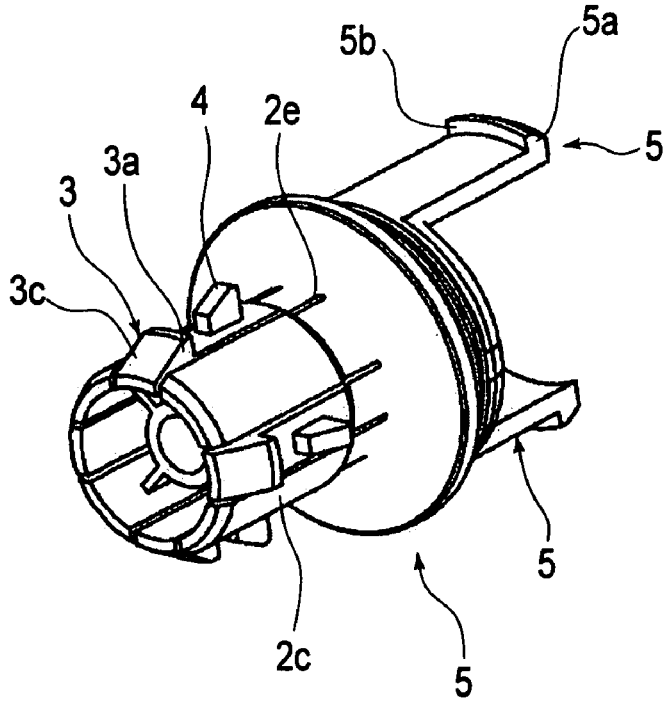

FIGS. 9(*a*) and 9(*b*) are perspective views of the sealing member 2 in this embodiment, as seen from the right and left sides thereof, respectively. FIGS. 10(*a*), 10(*b*), 10(*c*), 10(*d*), and 10(*e*) are a front view, a left side view, a right side view, a top view, and a sectional view at line A—A in 10(*b*), of the sealing member in this embodiment.

Figure 11:
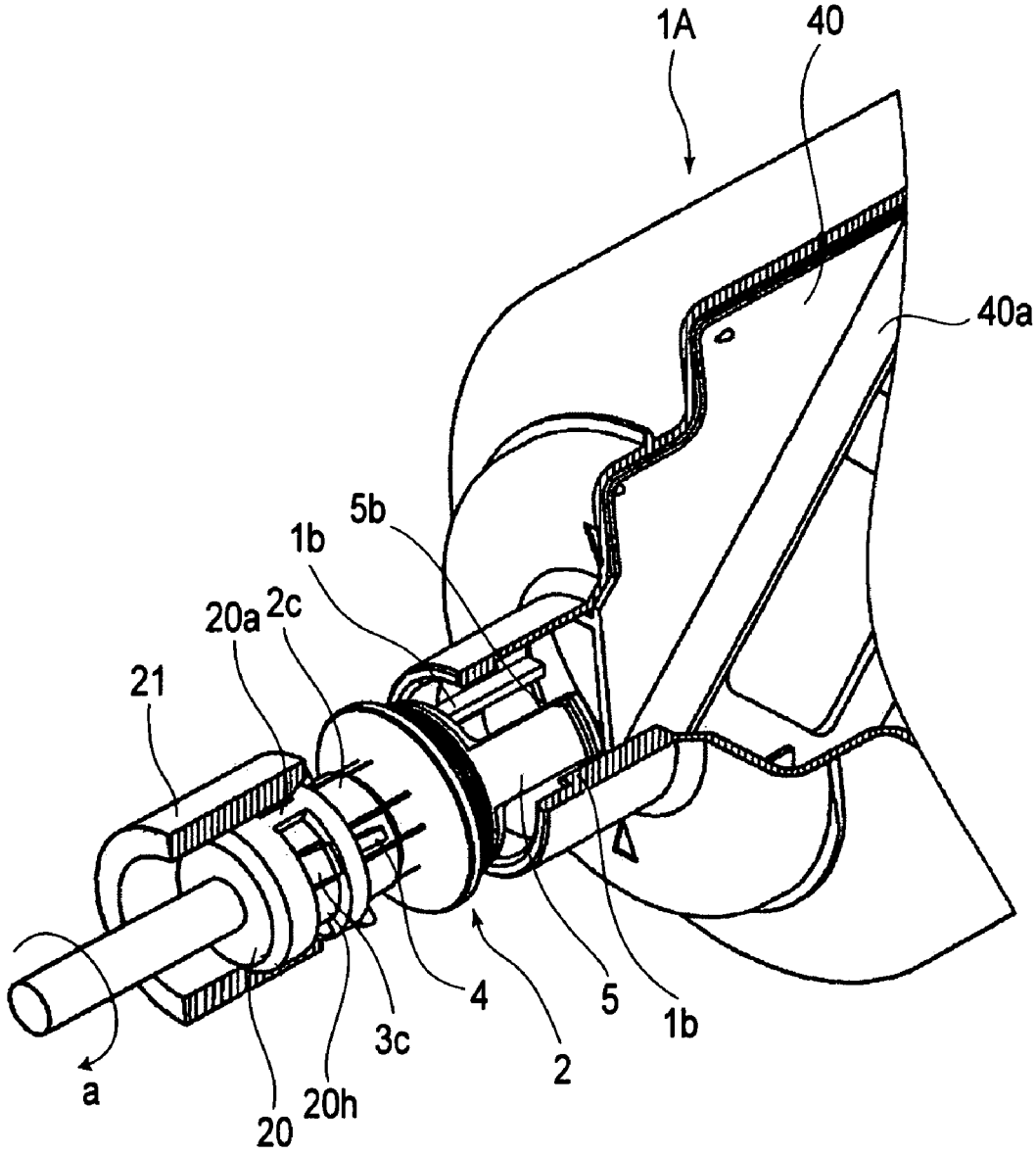
FIG. 11 is a partially broken perspective view of the sealing member of the toner supply container, driving force transmitting portion of the main assembly of the image forming apparatus, and their adjacencies, showing the state of engagement between the sealing member and driving portion.

FIG. 11 is a partially broken perspective view of the toner outlet portion of the toner supply container, and the driving force transmitting portion 20, in this embodiment, while the toner is supplied from the toner supply container to the apparatus main assembly 100 after the coupling of the toner supply container 1 and the driving portion 20.

Figure 10:
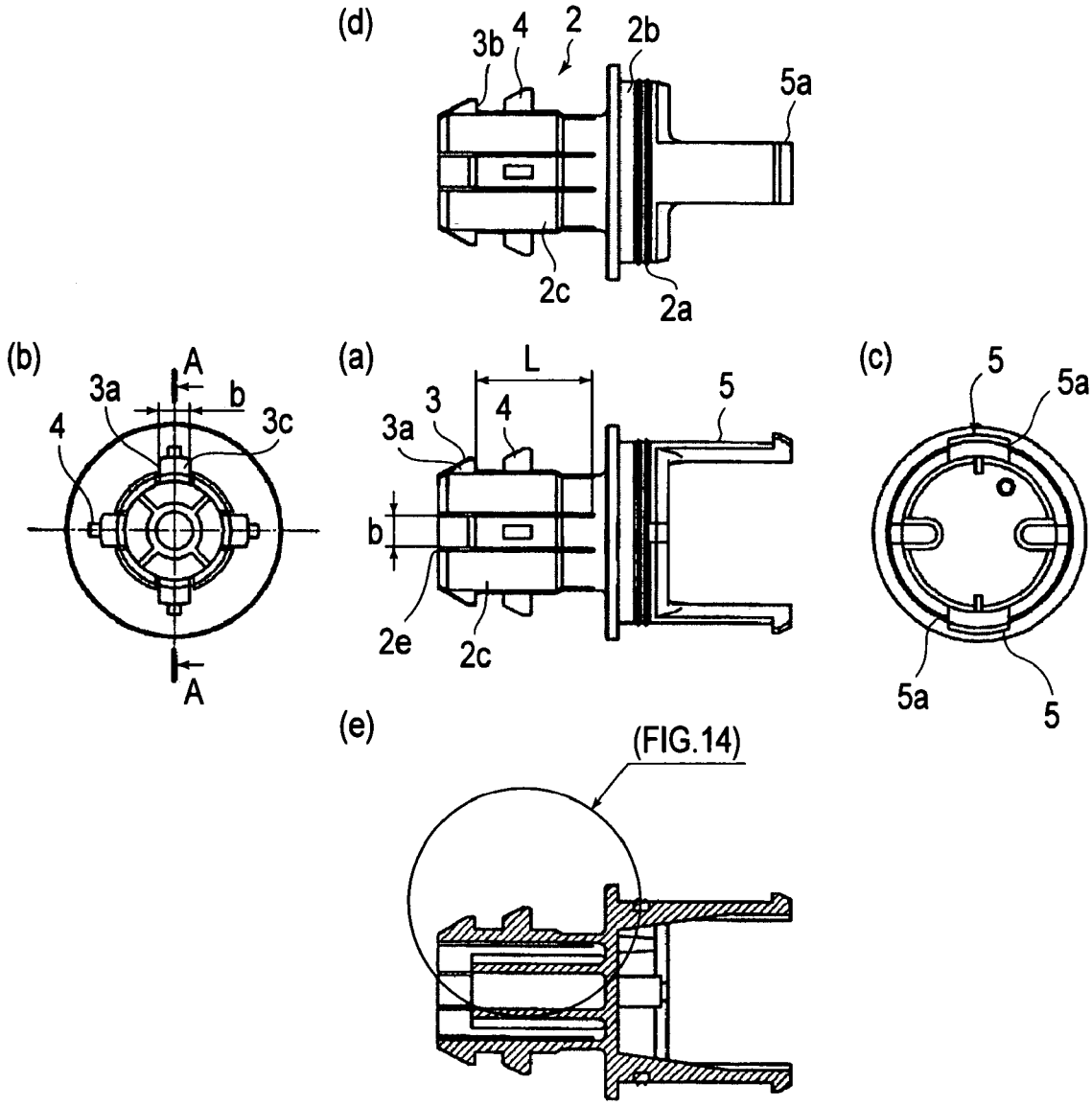
FIGS. 10(*a*), 10(*b*), 10(*c*), 10(*d*), and 10(*e*) are a front view, a left side view, a right side view, a top view, and a sectional view at line A—A in 10(*b*), of the sealing member of the toner supply container in accordance with the present invention.

Referring to FIGS. 9 and 10, the sealing member 2 is provided with a sealing portion 2*b* for sealing or unsealing the toner outlet 1*a* of the developer supply container 1, and a roughly cylindrical coupling portion 2*c*, as a snap-hooking portion, which couples with the driving portion 20 of the apparatus main assembly 100. The sealing portion 2*b*, or the cylindrical portion with a larger diameter, is externally fitted with a pair of seals 2*a*, the diameters of which are larger by an appropriate amount than that of the internal diameter of the toner outlet 1*a*. The seals 2*a* are for sealing the gap between the peripheral surface of the sealing portion 2*b* of the sealing member 2, and the internal surface of the toner outlet 1*a*. Therefore, the seals 2*a* are desired to have a proper amount of elasticity. Thus, in this embodiment, the seals 2*a* are integrally formed with sealing member 2, of an elastomer, which is different from the material for the main body of the sealing member 2, by two color injection molding.

As the sealing portion 2*b* is pressed into the toner outlet 1*a*, the outlet 1*a* as the toner discharging port, is sealed with the sealing member 2.

The sealing member 2 performs a plurality of functions for the toner supply container 1. The primary functions of the sealing member 2 are: (1) to unseal the toner outlet 1*a* by engaging with the apparatus main assembly 100; (2) to receive rotational force from the apparatus main assembly 100; (3) to transmit the received driving force to the bottle proper 1A of the toner bottle 1; and (4) to disengage the toner supply container 1 from the apparatus main assembly 100.

As described above, the sealing member 2 performs a plurality of important functions by itself. This is why the sealing member 2 in this embodiment has this unique structure.

Next, the sealing member 2 will be described in detail regarding the various structural features for performing the abovementioned functions.

[Coupling Portion]

Next, the referring to FIGS. 9–11, the structure of the coupling portion 2*c* of the sealing member 2 in accordance with the present invention will be described.

The sealing member 2 in accordance with the present invention is provided with the cylindrical coupling portion 2*c*. Thus, not only does the sealing member 2 function as a sealing member, but also, it functions as a driving force receiving member. It is enabled to receive the driving force from the driving force transmitting portion 20 of the toner supplying apparatus 400.

The cylindrical coupling portion 2*c*, as the snap-hooking portion, of the sealing member 2, comprises four portions capable of elastically deforming, and each of the four portions capable of elastically deforming has the latching projection 3. Thus, the slanted top surface of each of the tapered latching projections 3 is pressed by the driving portion 20, the portion with the latching projection 3 easily and elastically deforms. The cylindrical coupling portion 2*c* is also provided with the four unlatching projections 4, as the disengagement force receiving portion, for receiving from the main assembly of the image forming apparatus, the force for displacing the latching projections 3 to free the snap-fitting coupling portion 2*c* from the driving portion 20. They are on the peripheral surface the cylindrical coupling portion 2*c*. More specifically, they project, one for one, from the portions with the latching projection 3; there are four elastic portions with the latching projection 3. In other words, the cylindrical coupling portion 2*c* of the sealing member 2 in this embodiment is provided with four elastically deformable portions, which are evenly distributed in the circumferential direction of the cylindrical coupling portion 2*c*, and each elastically deformable portion is provided with the latching projection 3 and unlatching projection 4; the coupling portion 2*c* is provided with two pairs of mutually opposing latching projections 3, and two pairs of mutually opposing unlatching projections 4.

As for the structural arrangement on the main assembly side, the driving portion 20 of the apparatus main assembly 100 is provided with holes 20*h* for catching the latching projections 3 of the sealing member 2. Each of the latching projection catching hole 20*h* (which hereinafter will be referred to simply as "catching hole") is structured so that the latching projection 3 of the sealing member 2 fits into the catching hole 20*h* (surface 3*b* of latching projection 3 comes into contact with internal surface of hole 20*h*). In order to allow the sealing member 20 to smoothly enter the driving portion 20, the edge of the coupling hole of the driving portion 20 is tapered (provided with tapered surface 20*b*) to gradually reduce the diameter of the entry portion of the coupling hole. With the provision of this tapered surface 20*b*, the sealing member 2 is smoothly guided into the driving portion 20.

The driving portion 20 is provided with a plurality of ribs 20*a*, which are for transmitting the rotational driving force to the sealing member 2 by coming into contact with the driving force receiving surface 3*a* of the latching projection 3 after the engagement of the latching projections 3 into the catching holes 20*h*. In this embodiment, the driving portion 20 is provided with a pair of ribs 20*a*, which are disposed in a manner to oppose each other across the driving portion 20 in terms of the direction perpendicular to the rotational axis of the driving portion 20.

[Snap-fitting Portion]

Next, referring to FIGS. 9–11, the snap-fitting portion will be described in more detail.

In order to enable the sealing member 2 to receive the driving force from the apparatus main assembly 100, each of the snap-fitting portions of the sealing member 2 is provided with the latching projection 3, which is located at the tip portion of the snap-fitting portion. Each latching projection 3 projects perpendicularly outward in the radius direction of the sealing member 2 from the peripheral surface of the cylindrical coupling portion 2*c*. The latching projection 3 has the driving force receiving surface 3*a*, as the driving force receiving portion, by which the sealing member 2 receives the rotational force from the apparatus main assembly 100, and the load bearing surface 3*b* which comes, and remains, in contact with the internal surface of one of the catching holes 20*h* of the driving portion 20 of the apparatus main assembly 100, as the sealing member 2 is moved into the driving portion 20. This load bearing contact surface 3*b* is the surface by which the sealing member 2 remains engaged with the driving portion 20 when the sealing member is partially separated from the toner bottle 1 (when unsealing toner outlet 1*a*).

In other words, each latching projection 3 performs two different functions: the function performed by the driving force receiving surface 3*a*, that is, the function as a coupler for coupling the sealing member 2 with the driving portion 20 in order to make it possible for the sealing member 2 to receive the rotational driving force from the apparatus main assembly 100; and the function performed by the load bearing contact surface 3*b*, that is, the function as a latching (locking) portion for keeping the sealing member 2 engaged with the driving portion 20 in order to make it possible for the toner outlet 1*a* to be automatically unsealed as the sealing member 2 is slid outward relative to the bottle proper 1A.

Further, while the sealing member 2 receives the driving force from the driving portion 20, with the load bearing contact surface 3*b* remaining in contact with the internal surface of the catching hole 20*h*, the distance by which the sealing member 2 was pulled out from the toner bottle 1 is kept constant. Therefore, the amount by which the toner is discharged per unit length of time through the toner outlet 1*a* is kept constant, rendering the toner bottle 1 very accurate in terms of the amount by which toner is discharged per unit length of time. Further, the sealing member 2 reliably remains engaged with the driving portion 20 of the apparatus main assembly 100. Therefore, there is no possibility that the sealing member 2 will become disengaged from the drive shaft 1*b* while the toner is discharged. In other words, this embodiment assures that the toner is satisfactorily discharged.

With the provision of the above described structural arrangement, the function of automatically unsealing or resealing the toner outlet 1*a* of a toner supply container, and the function of receiving the driving force from the main assembly of an image forming apparatus and transmitting the received driving force to the container proper 1A of the toner supply container, can be carried out by a single component, that is, the sealing member 2. Therefore, it is possible to provide a toner supply container which is simple in structure and inexpensive.

Not only is the latching projection 3 required to have the latching function, but also, driving force receiving function. Therefore, it is desired to have a certain amount of rigidity. Thus, the coupling portion 2*c* of the sealing member 2 is provided with a plurality of pairs of slits 2*e*, which extend in the direction parallel to the axial line of the sealing member 2 from the base portion of the coupling portion 2*c* to its tip, being positioned so that each pair of slits 2 sandwich one of the latching projections 3. With the provision of these slits 2*e*, each of the portions of the coupling portion 2*c* having the latching projection 3 is enabled to freely and elastically deform toward the axial line of the coupling portion 2*c*. Another reason for provision of these slits 2*e* is for enabling the latching projections 3 to be displaced by the action from the apparatus main assembly 100 in order to disengage the sealing member 2 (toner supply container 1) from the apparatus main assembly 100.

Although each of the latching projections 3 in this embodiment is integrally formed as a part of the sealing member 2, this embodiment is not intended to limit the scope of the present invention. In other words, the latching portion 3 as a part of the snap-fitting portion of the sealing member 2 may be integrally formed with the sealing member 2, or the latching projection and sealing member 2 may be formed independently from each other.

Figure 12:
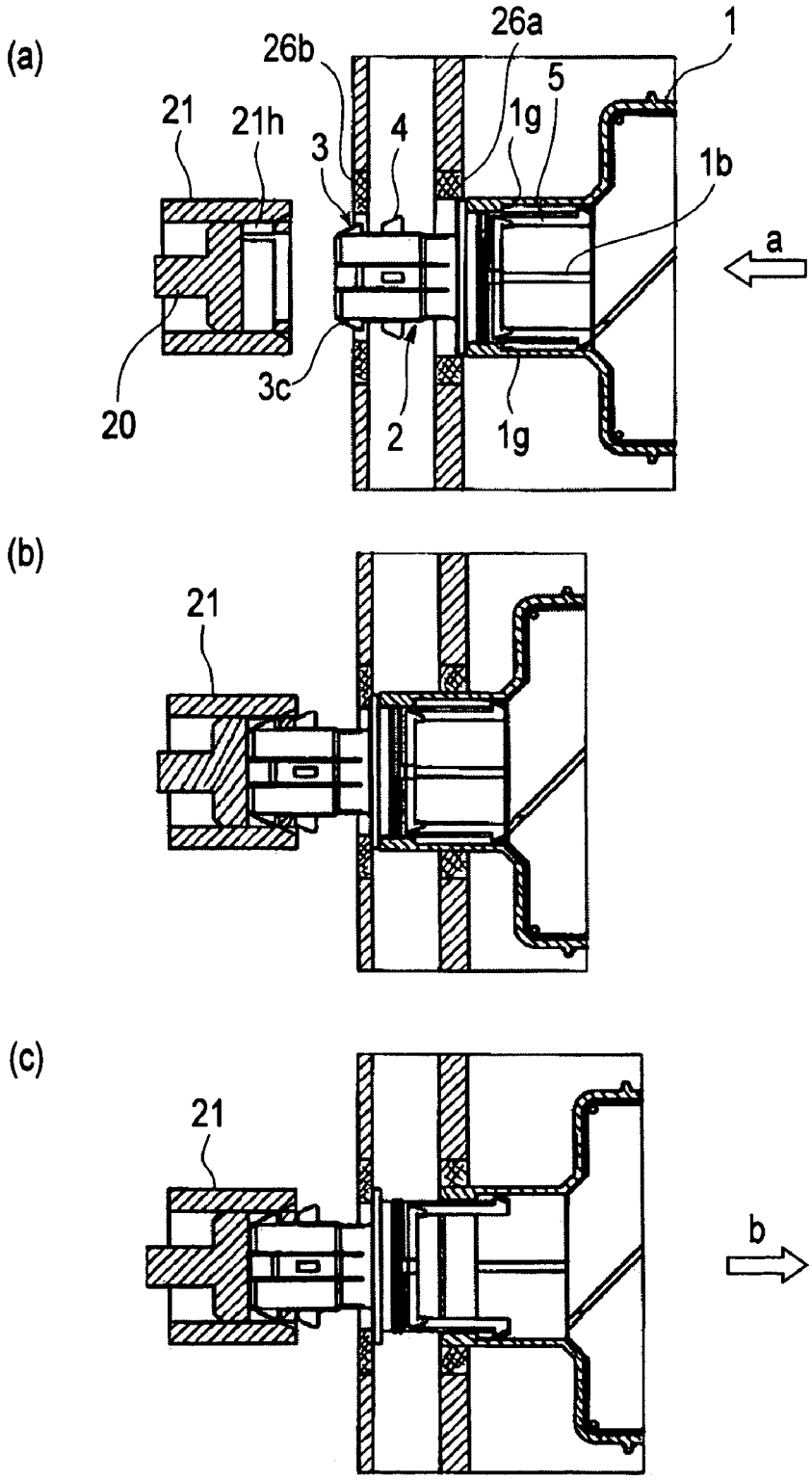
FIGS. 12(*a*), 12(*b*), and 12(*c*) are sectional views of the sealing member portion of the toner supply container and the driving force transmitting portion of the main assembly of the image forming apparatus, showing the process of coupling the sealing member with the driving transmitting portion, immediately prior to the insertion of the toner bottle (toner supply container), during the insertion, and immediately after the unsealing of the toner bottle, respectively.

Also in this embodiment, each of the latching projections 3 is tapered; it is provided with the surface 3*c* as the contact surface, in order to enable the sealing member 2 to smoothly enter the driving portion 20 of the apparatus main assembly 100. This contact surface 3*c* is the surface which comes into contact with the internal surface of the cylindrical driving portion 20, and receives from the internal surface of the cylindrical driving portion 20, the force for displacing the latching projection 3 (snap-fitting portion) toward the axial line of the sealing member 2 so that the sealing member 2 is allowed to enter the driving portion 20, as shown in FIGS. 11 and 12. As the sealing member 2 enters deeper into the driving portion 20, the contact surface 3*b* comes closer to the catching hole 20*h* of the driving portion 20. Then, as the sealing member 2 enters even deeper into the driving portion 20, the latching projection 3 is moved past the edge of the catching hole 20*h*. As a result, the slanted surface 3*c* becomes disengaged from the internal surface of the driving portion 20, and therefore, the pressure being applied to the latching projection 3 disappears, allowing the portion of the coupling portion 2*c*, from which the latching projection 3 projects, to regain its original shape. Therefore, the contact surface 3*b* of the latching projection 3 comes into contact with the internal surface of the catching hole 20*h*, ending the processing of the coupling the sealing member 2 (snap-fitting portions of sealing member 2) with the apparatus main assembly 100 (driving portion 20 of apparatus main assembly 100).

After the completion of the coupling process, the bottle proper 1A is slid backward a predetermined distance by the mechanism of the apparatus main assembly 100 which is moved by the movement of the toner bottle exchange front cover 15, as described above. As a result, the sealing member 2 is apparently moved relative to the container proper 1A, unsealing the toner outlet 1*a* to enable the toner supply container 1 to discharge the toner therein. In other words, in this embodiment, the sealing member 2 is held to the apparatus main assembly 100 in a manner to regulate the sealing member 2 in terms of the movement in which the toner bottle 1 is slid, making it possible to seal or unseal the toner outlet 1*a* by moving the bottle proper 1A of the toner bottle 1 forward or backward, respectively.

[Unlatching Projection]

Next, the unlatching projection 4 for unlatching the latching portion 3, which is paired with the latching projection 3, will be described. The unlatching projection 4 is a projection for disengaging the sealing member 2 remaining engaged with the driving portion 20 of the apparatus main assembly 100, when exchanging the toner supply container 1. In other words, the engagement between the toner supply container 1 in the apparatus main assembly 100 and the apparatus main assembly 100 is dissolved by the unlatching projection 4 in order to remove the toner supply container in the apparatus main assembly 100 and replace it with a new toner supply container.

The unlatching projection 4 performs the function of unlatching the latching projection 3 from the driving portion 20. More specifically, the unlatching projection 4 is disposed so that its position is best suited for unlatching the latching projection 3. As the unlatching projection 4 is pressed by sliding movement of the toner supply container releasing member 21, the latching projection 4 is forced to displace toward the axial line of the sealing member 2, while elastically deforming the portion of the coupling portion 2*c*, from which the latching projection 3 projects. As a result, the latching projection 3 is moved out of the catching hole 20*h*; it is disengaged from the driving portion 20.

In this embodiment, the coupling portion 2*c* of the sealing member 2 is provided with four pairs of the latching projection 3 and unlatching projection 4, which are evenly distributed on the peripheral surface of the coupling portion 2*c* in terms of the circumferential direction. However, the numbers and locations of the latching projections 3 and unlatching projections 4 are optional. In other words, the coupling portion 2*c* may be provided with only one pair of the latching and unlatching projections 3 and 4, respectively, or two, three or more pairs.

The processes of coupling and uncoupling of the sealing member 2 will be described later in more detail with reference to FIGS. 12 and 13.

At this time, another function of the sealing member 2, that is, the transmission of the driving force from the main assembly of the image forming apparatus to the bottle proper 1A of the toner bottle 1, will be described in detail.

Referring to FIGS. 9 and 10, the sealing member 2 is provided with a pair of the driving force transmitting portions 5 for transmitting the rotational driving force from the image forming apparatus main assembly to the container proper 1A. The driving force transmitting portions 5 constitute the opposite end of the sealing member 2 from the coupling portion 2*c*. The driving force transmitting portions 5 oppose each other across the sealing member 2, in terms of the direction perpendicular to the axial line of the sealing member 2. Each driving force transmitting portion 5 projects in such a direction that as the sealing member 2 is inserted, it projects into the toner outlet 1*a*. Although the sealing member 2 in this embodiment is provided with a pair of driving force transmitting portions 5 which oppose each other across the sealing member 2, this embodiment is not intended to limit the number, shape, and location of the driving force transmitting portions 5. In other words, the number, shape, location of the driving force transmitting portions 5 are optional. For example, the number of the driving force transmitting portions 5 may be three, or only one.

One of the lateral surfaces of the driving force transmitting portion 5 constitutes a driving surface 5*a* for transmitting the driving force in the rotational direction. This driving surface comes into contact with the driving force receiving portion 1*b*, which will be described later, to transmit the driving force.

<Engagement of Sealing Member with Driving Portion>

Next, referring to FIG. 12, the process of the engagement between the driving portion 20 with the sealing member 2 will be described. FIG. 12(*a*) shows the states of the developer supply container 1 and the apparatus main assembly 100, in which the former is being inserted by a user into the latter in the direction indicated by an arrow mark a to be set in the latter, and in which the former is yet to be engaged with the driving portion 20 of the latter.

As the developer supply container 1 is further inserted from the position shown in FIG. 12(*a*), the slanted surface 3*c* of each latching projection 3 of the sealing member 2 comes into contact with the driving portion 20, and then, the sealing member 2 is inserted, with the latching projection 3 being gradually displaced toward the axial line of the sealing member 2 (portion of coupling portion 2*c* having latching projection 3 gradually deforming toward axial line of sealing member 2), as shown in FIG. 12(*b*).

As the developer supply container 1 is advanced even further, the latching projection 3 is moved past the conic portion of the internal surface of the driving portion 20, and then, the plain cylindrical portion. As the latching projection 3 is moved past the plain cylindrical portion, it encounters a void, or the latching projection catching hole 20*h* (FIG. 11), which is a space between the adjacent two driving force transmission ribs 20*a* in terms of the circumferential direction of the sealing member 2. As a result, the pressure having been applied to the latching projection 3 by the internal surface of the driving portion 20 disappears, allowing the latching projection 3 to fit into the catching hole 20*h*; the latching projection 3 latches with the driving portion 20, as shown in FIG. 12(*c*). In this state, the latching projection 3 is firmly engaged with the driving portion 20, making it virtually impossible for the sealing member 2 to move relative to the apparatus main assembly 100 in terms of the thrust direction (direction parallel to axial line of sealing member 2).

Thus, even if the developer supply container 1 is moved backward in the direction indicated by an arrow mark b in FIG. 12(*c*), the sealing member 2 does not moved backward with the container proper 1A of the developer supply container 1; it remains attached to the driving portion 20. In other words, only the container proper 1A of the developer supply container 1 is moved backward. Therefore, the sealing member 2 is partially separated from the container proper 1A, unsealing thereby the toner outlet 1*a*. Incidentally, regarding the backward movement of the developer supply container 1, the toner supplying apparatus 400 of the main assembly 100 may be structured so that the toner supply container 1 is slid by the opening or closing movement of the toner container exchange front cover 15.

As for the sliding of the sealing member 2 relative to the driving portion 20, the container proper 1A of the toner supply container 1 may be slid while the sealing member 2 is kept immobilized, or the sealing member 2 may be slid while the driving portion 20 is kept immobilized. Further, both the sealing member 2 and driving portion 20 may be slid. The process to be carried out to remove the empty developer supply container 1 in the apparatus main assembly 100 in order to exchange it with a new toner supply container after the depletion of the toner in the toner supply container 1 in the apparatus main assembly 100 is the reverse of the above described process to be carried out to mount (coupling and unsealing) the bottle.

More specifically, as an operator opens the above described toner container exchange front cover 15, the following steps are first carried out by the force generated by the movement of the front cover 15: First, the container proper 1A of the toner supply container 1 is moved inward of the apparatus main assembly 100, with the sealing member 2 remaining engaged with the apparatus main assembly 100. As a result, the toner outlet 1*a* is automatically resealed by the sealing member 2. Then, the unlatching projections 4 are pressed toward the axial line of the sealing member by the releasing member 21, which will be described later, causing thereby the latching projections 3 to come out of the catching holes 20*h*. Then, the toner supply container 1 is withdrawn with the sealing member 2, with the latching projections 3 kept out of the catching holes 20*h*. As a result, the sealing member 2 is disengaged from the apparatus main assembly 100, ending thereby the process of readying the toner supply container 1 for removal.

[Method for Disengagement]

After the completion of the operation for supplying the apparatus main assembly 100 with toner, that is, as the developer supply container 1 becomes empty, the used developer supply container 1 must be removed to be replaced with a new toner supply container. Thus, the engagement between the sealing member 2 and driving portion 20 must be dissolved. Next, the disengaging of the latching projection 3 from the driving portion 20 of the apparatus main assembly 100 will be described with reference to FIG. 13.

Figure 13:
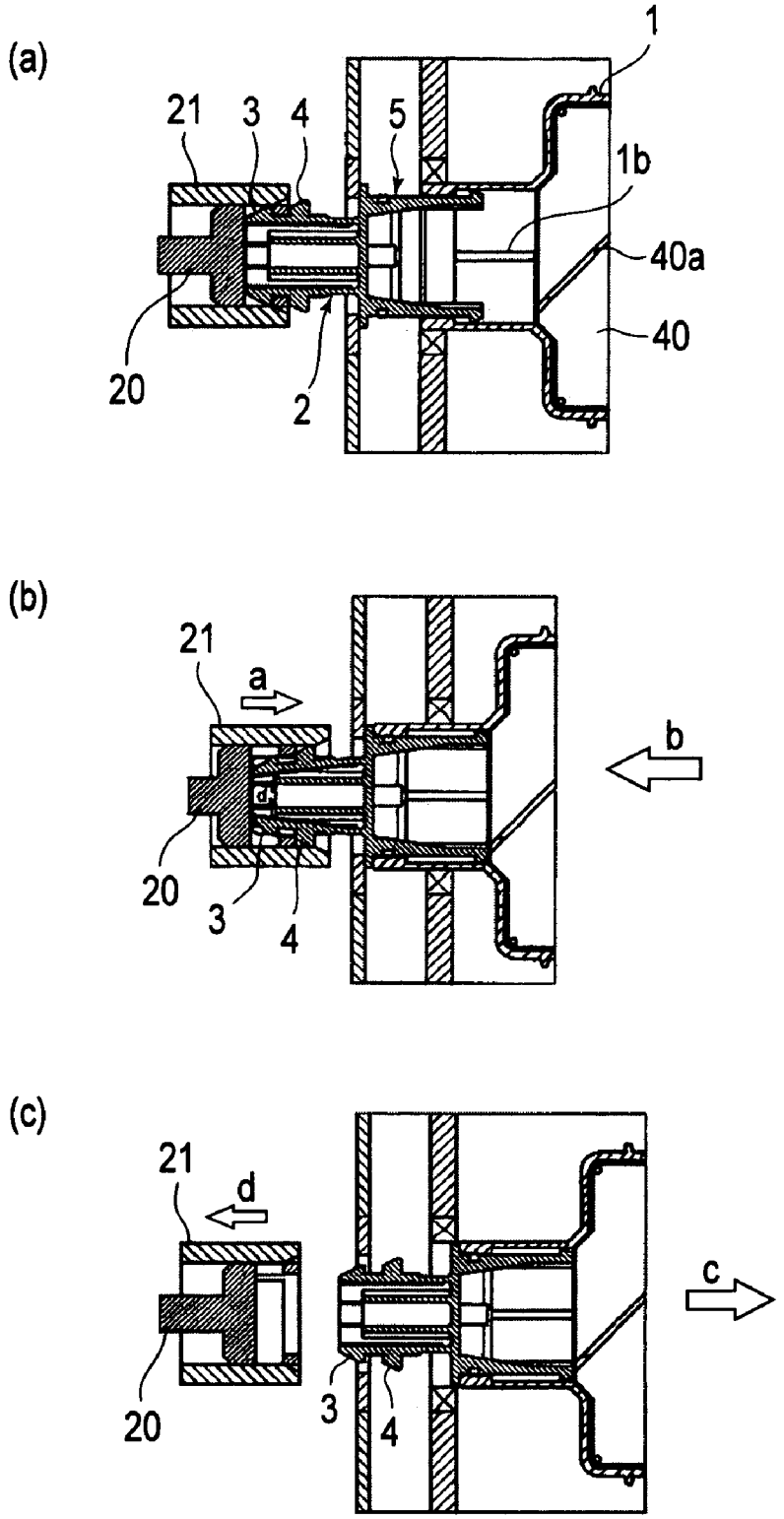
FIGS. 13(*a*), 13(*b*), and 13(*c*) are sectional views of the sealing member portion of the toner supply container and the driving force transmitting portion of the main assembly of the image forming apparatus, showing the process of uncoupling the sealing member from the driving force transmitting portion, immediately prior to the uncoupling, during the uncoupling, and at the completion of the uncoupling, respectively.

Referring to FIG. 13, the apparatus main assembly 100 is provided with the latching projection releasing member 21 (which hereinafter will be referred to as releasing member 21). More specifically, there is the releasing member 21 in the driving portion 20. The releasing member 21 is movable in the direction parallel to the axial line of the developer supply container 1. FIG. 13(*a*) shows the states of the driving portion 20 and toner supply container 1 immediately after the completion of the toner supplying operation, in which the toner outlet 1*a* of the developer supply container 1 is open. As the container exchange front cover 15 is opened when the toner supply container 1 and driving portion 20 are in the states shown in FIG. 13(*a*), the container proper 1A is slid in the direction indicated by an arrow mark b by the force generated by the movement of the cover 15, resealing thereby the outlet 1*a*. Then, the releasing member 21 is slid in the direction indicated by an arrow mark a. As the releasing member 21 advances in the arrow a direction, the unlatching projections 4 located on the cylindrical coupling portion 2*c* of the top of the sealing member 2 are displaced toward the axial line of the sealing member 2, causing the portion of coupling portion 2*b*, from which unlatching projections 4 project, to elastically deform toward axial line of sealing member 2, as shown in FIG. 13(*b*). As a result, the latching projections 3 projecting from the same portions of the coupling portion 2*c* as do the unlatching projections 4 are also displaced toward the axial line of the sealing member 2, being thereby disengaged from the driving portion 20.

Thereafter, the releasing member 21 is further moved in the arrow a direction by the movement of the front cover 15, and also, the developer supply container 1 is slid in the arrow c direction by the movement of the front cover 15, as shown in FIG. 13(*c*). As a result, the releasing member 21 presses the sealing member 2 into the outlet 1*a*, completely resealing the toner outlet 1*a* of the developer supply container 1. Then, as the releasing member 21 is advanced further in the arrow a direction, the entirety of the toner supply container 1 is slid to the location from which it can be easily removed from the apparatus main assembly 100 by a user.

Regarding the mechanism for driving the releasing member 21, the apparatus main assembly 100 may be structured so that the releasing member 21 is moved by the movement of the container exchange front cover 15, more specifically, so that as the container exchange front cover 15 is opened, the releasing member 21 is moved in the arrow a direction by the movement of the front cover 15, causing thereby the sealing member 2 of the developer supply container 1 to be partially separated from the driving portion 20, and as the front cover 15 is closed, the releasing member 21 is moved in the direction indicated by an arrow mark d by the movement of the front cover 15. Instead, the apparatus main assembly 100 may be provided with a motor or the like dedicated to the releasing member 21 so that the releasing member 21 is moved independently from the movement of the front cover 15. Further, the apparatus main assembly 100 may be provided with a manual lever, the movement of which disengages the sealing member 2 from the driving portion 20. In other words, the method for moving the releasing member 21 is optional.

As described above, this embodiment assures that the toner bottle 1 can be properly snap-fitted with the main assembly of an image forming apparatus simply by inserting the toner bottle 1 into the main assembly, and also, that the toner bottle 1 can be easily disengaged from the main assembly simply by pressing the toner supply container unlatching portion 4. Therefore, this embodiment makes it possible to provide a a combination of a toner bottle and a toner supplying apparatus, which is very simple in structure, and yet, is superior in operability in terms of toner replenishment.

Further, according to this embodiment, the sealing member 2 for sealing or unsealing the toner outlet 1*a* of the toner supply container 1 is enabled to transmit the driving force for rotationally driving the container proper 1A of the toner supply container 1, eliminating the need for providing the apparatus main assembly 100 with both the mechanism for moving the sealing member 1, and the mechanism for rotationally driving the container proper 1A, which is independent from the sealing member moving mechanism. In other words, the two functions can be performed by a single component, making it possible to provide a toner replenishment system which is very compact and inexpensive.

Moreover, this embodiment makes it possible to realize a driving force transmitting system which is highly reliable while being very simple in operation, simple in structure, and inexpensive.

Further, not only the latching projections 3, but also, the unlatching projections 4 are disposed on the peripheral surface of the cylindrical coupling portion 2*c*, making it easier to remove the sealing member 2 from the mold therefor, when manufacturing the sealing member 2 of resin by injection molding. Thus, the sealing member 2 in accordance with the present invention is preferable to sealing members in accordance with the prior art, in terms of manufacturing productivity.

Further, each latching projection 3 is made greater in width (in terms of circumferential direction of sealing member) than each unlatching projection 4, being therefore strong enough to withstand the force to which it is subjected when the bottle proper 1A is withdrawn to automatically and partially separate the sealing member from the outlet 1*a* of the toner bottle 1, that is, being strong enough to prevent the latching projection 3 from disengaging from the driving portion 20. Since the unlatching projection 4 is not subjected to such a force, it is made narrower than the latching projection 3 to reduce as much as possible the manufacturing cost of the sealing member 2 in terms of the resinous material.

Figure 14:
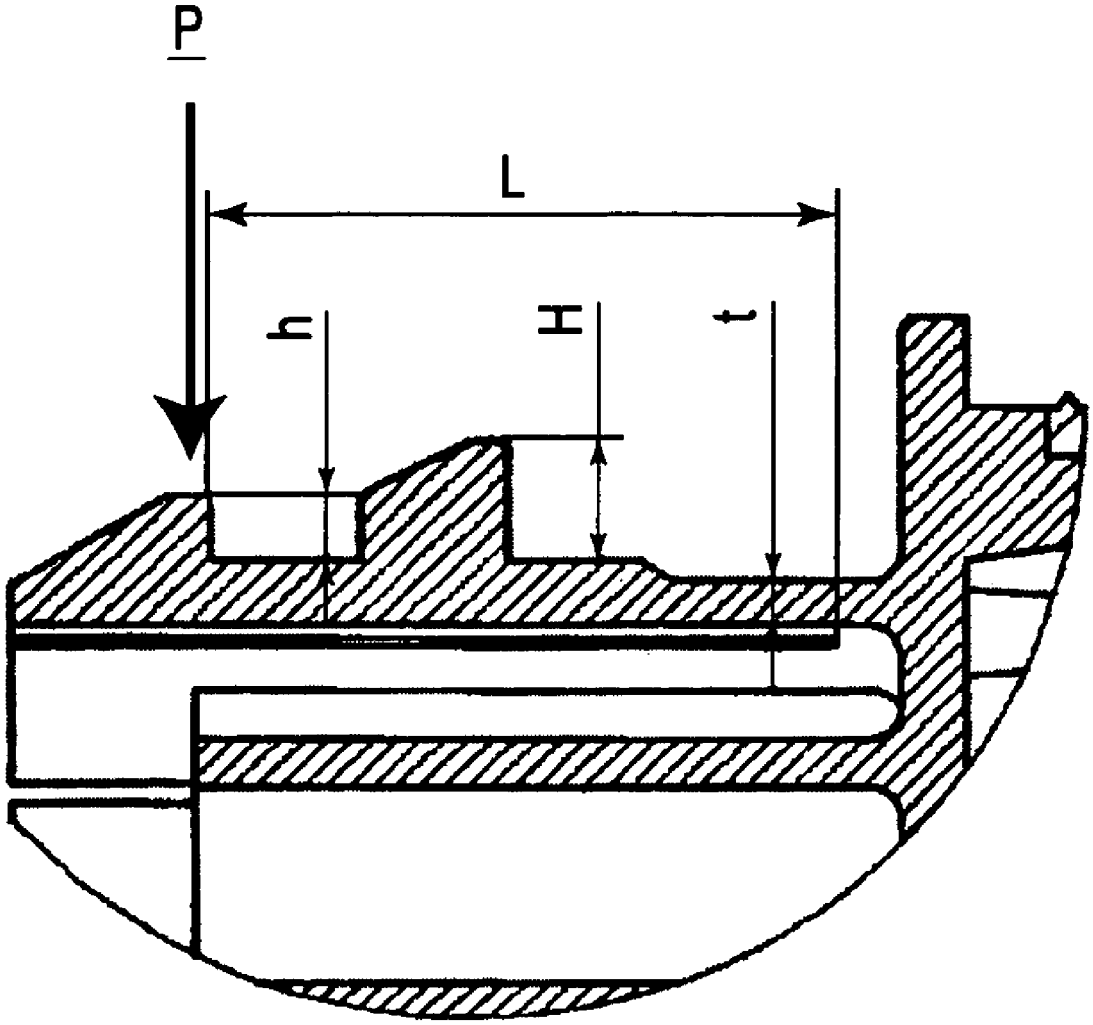
FIG. 14 is an enlarged sectional view of the snap-fitting portion of the sealing member, showing the relationship among the dimensions of the various portions of the snap-fitting portion.

Further, in this embodiment, in order to allow the snap-fitting portion, from which the latching projection 3 and unlatching projection 4 project, to easily flex, the base portion of the snap-fitting portion is made thinner (thickness=t) than the rest of the snap-fitting portions as shown in FIG. 14. Shaping the snap-fitting portion as described above ensures, without sacrificing in rigidity the latching portion 3 and unlatching portion 4 which are subjected to the rotational driving force, that the sealing member 2 satisfactorily engages with, or disengages from, the driving portion 20.

[Values of Mechanical Properties of Sealing Member]

As described above, the snap-fitting portion in this embodiment is given the function of receiving the "rotational driving force", in addition to the function of "snap-fitting" (engaging) with the driving portion 20. Thus, in order for the snap-fitting portion to be highly satisfactory in performing both functions, the snap-fitting portion is required to have two contradictory properties, that is, a proper amount of elasticity and a proper amount of rigidity.

On one hand, if the snap-fitting portion, from which the latching projection 3 projects, is increased in rigidity, for example, it increases in durability, being therefore capable of withstanding the larger amount of torque to which it will be subjected when it is used for a toner bottle (developer supply container) of a large capacity. However, increasing the snap-fitting portion in rigidity increases the amount of force necessary to be applied to snap-fit (engage) the snap-fitting portion with the driving portion 20 when inserting the toner bottle into the main assembly of an image forming apparatus, and the amount of force necessary to be applied to disengage the snap-fitting portion (sealing member) from the driving portion 20 (apparatus main assembly 100). In other words, it increases the amount of force necessary to mount or dismount the toner bottle, reducing thereby the toner bottle in toner replenishment efficiency.

On the other hand, if the snap-fitting portion, from which the latching projection 3 projects, is decreased in rigidity, it reduces in durability, or allows the latching projection 3 to easily disengage from the driving portion 20 of the main assembly, making it possible that the sealing member fails to remain satisfactorily engaged with the driving portion 20.

Therefore, it is very important to select, as the material for the coupling portion (sealing member), a material which is well balanced in elasticity and rigidity, that is, which makes the coupling portion as small as possible in terms of the amount of force necessary to elastically deform the snap-fitting portion, and yet, enables the snap-fitting portion to withstand a substantial amount of torque.

Next, the "flexural elastic modulus" of the material for the snap-fitting portion (of sealing member), as one of the mechanical properties of a substance, which affects the above described functions of the sealing member 2, will be described.

The snap-fitting portion is required to be relatively small in the amount of the force necessary to elastically (resiliently) deform toward the axial line of the sealing member 2, and also, to be rigid enough in terms of the rotational direction of the sealing member 2 to reliably receive the rotational driving force.

Thus, in this embodiment, a substance capable of providing the snap-fitting portion of the sealing member with a flexural elastic modulus of 1,400–20,000 MPa, is used as the material for the snap-fitting portion (sealing member). The preferable range for the flexural elastic modulus of the snap-fitting portion is 2,600–5,590 MPa.

If the snap-fitting portion is lower in flexural elastic modulus than a certain value, it is too slow in the speed at which it recovers after being elastically deformed. Thus, if the toner supplying system is structured so that a toner bottle is withdrawn immediately after the completion of the engagement of the toner bottle with the driving portion (to which toner bottle is engaged) of the main assembly of an image forming apparatus as it is in this embodiment, the sealing member will be moved with the toner bottle before the snap-fitting portion completely recovers from the elastic deformation, making it possible that the snap-fitting portion will fail to properly engage with the driving portion. On the other hand, if the snap-fitting portion is extremely high in flexural elastic modulus, it is too rigid, being therefore extremely large in the mount of force necessary to elastically deform it, that is, extremely large in the amount of force necessary to operate the toner supply container. In other words, forming the snap-fitting portion (sealing member) so that it will be extremely high in flexural elastic modulus reduces the toner supply container in usability. Therefore, the flexural elastic modulus of the snap-fitting portion is desired to be set to a proper value, or the values in the above described range.

As will be understood, the sealing member 2 is desired to be manufactured of resinous material such as plastics or the like by injection molding. However, the material for the snap-fitting portion (sealing member) and the method for manufacturing the sealing member are optional. That is, the sealing member may be formed of a material different from the one used in this embodiment, with the manufacturing method different from the one in this embodiment. Further, the sealing member may be molded in a single piece, or in two or more pieces which are joined after the molding.

For example, it is possible to use the two color ejection molding method to form the main portion of the sealing member 2 of an ABS resin which has proper amounts of elasticity and rigidity, and form the seal portions of the sealing member 2 of elastomer which is softer and more elastic than the material for the main portion. Using such materials and manufacturing method makes it possible to provide a sealing member high in durability and capable of very reliably keeping sealed the toner outlet of a toner supply container.

Further, when necessary to keep the cost of the sealing member as low as possible, the sealing member may be formed of a single material. For example, the sealing member molded of a type of polyethylene resin, or the like, alone, which is relatively high in elasticity, is definitely satisfactory from the standpoint of practicality.

As for the preferable resinous materials for the sealing member in this embodiment, there are ABS resin, polystyrene resin, polyethylene resin, polypropylene resin, straight chain polyamide resin (for example, Nylon (commercial name)), polyester resin, and the like. According to this embodiment, a proper combination can be chosen from among the abovementioned materials, and can be processed as necessary to give the sealing member a desired amount of flexural elastic modulus.

As described above, in this embodiment, the snap-fitting portion, or a portion of the sealing member, which supports the latching projection 3 and unlatching projection 4, is made elastically deformable. Therefore, the elastic deformation of the portion supporting the latching projection 3 and unlatching projection 4, and its recovery from the deformation, can be utilized to engage the latching projection 3 with the driving portion 20 or disengage it therefrom, making it possible to simplify the sealing member in structure. Further, the abovementioned materials have a proper range of elasticity for making it possible for the driving portion 20 and latching projection 3 to easily engage with each other, or disengage from each other. In addition, these materials are strong enough for the portion supporting the latching projection 3 and unlatching projection 4 to be durable.

[Relationship Among Various Portions of Snap-fitting Portion in Terms of Measurements]

Other properties of the sealing member, which are just as important as the mechanical property of the sealing member, are "shape and measurements" of the snap-fitting portion of the sealing member, because the "shape and measurements" of the snap-fitting portion have a certain amount of effect upon the elasticity and rigidity of the snap-fitting portion.

It is desired that the flexural elastic modulus of the snap-fitting portion is within the abovementioned range, and also, that the shape and measurements of the snap-fitting portion satisfy the requirements which will be described below.

FIGS. 10 and 14 show the relationship in terms of measurements among the various portions of the snap-fitting portion. In these tables, a letter b stands for the width (length in terms of rotational direction) of the latching projection 3; L, the length of the portion of snap-fitting portion, exclusive of the latching projection 3, which remains deformed while the snap-fitting portion is in engagement with the driving portion 20; t, thickness of the base portion of the elastically deformable portion of the snap-fitting portion; h, the height of the latching projection 3; and a letter H stands for the height of the unlatching projection 4. The elastically deformable property of the portion of the sealing member, from which the latching projection 3 projects can be optionally set by optimizing the relationship, in terms of measurements, among the measurements of the abovementioned various portions of the snap-fitting portion. The studies made regarding the relationship (ratio) among the measurements of the various portions of the snap-fitting portion revealed the following:

First, "b" is related to the strength of the latching projection 3 against the rotational driving force which the sealing member 2 receives from the driving portion 20. The greater the width b, or the measurement of the latching projection in terms of the rotational direction of the sealing member, the stronger the latching projection 3, and therefore, the more durable. However, if the width b is extremely large, it is highly likely that the snap-fitting portion will fail to satisfactorily engage with the driving portion 20. Therefore, it is very important that the width b be set to as small a value as possible within a range in which the latching projection 3 can withstand the rotational driving force.

Next, as for "L", it is desired to be as short as possible from the standpoint of compactness. However, if "L" is less than a certain value, the snap-fitting portion is difficult to elastically deform. Therefore, "L" should be set to a value at which proper balance will be provided between compactness and elasticity.

Thickness "t" is the factor which has a substantial amount of effect upon the strength of the snap-fitting portion. Further, there is a strong relationship between "t" and "L". In other words, the greater the "t", the higher the snap-fitting portion in rigidity.

Further, "h" equals the amount by which the latching projection 3 is displaced. In other words, in order for the snap-fitting portion to enter the driving portion 20, it must be elastically deformed by the amount equal to the "h". Thus, in order to reduce the amount by which the snap-fitting portion is to be elastically deformed, the height h is desired to be as low as possible. However, if the height h of the latching projection is lower than a certain value, the latching projection 3 fails to remain engaged with the driving portion 20; it easily disengages from the driving portion 20. Thus, the height h should be set to a value at which proper balance is provided between the amount by which the snap-fitting portion is elastically deformed and the prevention of the disengagement between the snap-fitting portion and driving portion 20.

Further, "H" must be greater than the "h"; the unlatching projection 4 must be taller than the latching projection 3 (H>h). This is because, in order for the unlatching projection 4 to disengage the latching projection 3 from the driving portion 20 by coming into contact with the internal surface of the above described hollow cylindrical releasing member 21, the unlatching projection 4 must be taller than the latching projection 3.

The relationship, in terms of measurements, among the various portions of the snap-fitting portion in this embodiment is desired to be made to be as follows:

The ratio of the width b to the length L is desired to be in the range of 0.11–0.5 (b/L=0.11–0.5).

The ratio of the thickness t to the length L is desired to be in the range of 0.05–0.15 (t/L=0.05–0.15).

The ratio of the height h to the length L is desired to be in the range of 0.04–0.25 (h/L=0.04–0.25).

If these ratios are outside the above given ranges, the snap-fitting portion will be too weak, or too strong, and therefore, it is highly probable that problems will occur.

[Verification of Proper Values for Mechanical Properties of Sealing Member]

The following are the results of the verification of the relationship between the above described flexural elastic modulus of the snap-fitting portion of the sealing member, and the measurements of the various portions of the snap-fitting portion. The sealing members 2 in the following tests were formed by injection molding, and were tested for (1) flexural elastic modulus P, (2) probability of the occurrence of unsatisfactory engagement or disengagement of the sealing member when the toner supply container is repeatedly mounted into the main assembly of an image forming apparatus and dismounted therefrom, 100 times, and (3) durability of the snap-fitting portion tested by intermittently rotating the toner supply container. The results are summarized in FIG. 15. Hereafter, the sealing members in the first to sixth embodiments of the present invention, and the comparative examples of the sealing members, will be described.

Embodiment 1

<Sealing Member>

Material: HD-PE resin, maker & grade: Suntech HD (J310), and flexural elastic modulus: 1,400 MPa.

Measurements of snap-fitting portions: width b=5 mm; length L=21 mm; thickness t=2 mm; height h=2.5 mm; height H=2.75 mm; number of latching projections was four (see FIG. 10 for shape); external diameter at the opening on the outlet side=30.4 mm; and external diameter of the coupling portion=20 mm.

<Container Proper of Toner Supply Container>

The cylindrical bottle proper was formed of HI-PS resin. The external diameter of bottle=120 mm; bottle length=320 mm; and wall thickness=2 mm. The flange was welded to the thus formed container proper, yielding a toner bottle shown in FIG. 6. After the sealing member 2 was pressed into the toner outlet 1*a*, the toner bottle was filled with 2,000 g of magnetic toner, yielding a brand-new toner bottle.

First, in order to measure the flexural elastic modulus P of the snap-fitting portion of the thus formed sealing member 2, the sealing member 2 was set in a compression-tension tester described below. Then, the flexural elastic modulus P of the snap-fitting portion was measure by elastically deforming by the amount equal to the height h of the latching projection 3 by applying load to a predetermined point (indicated by arrow mark P) of the latching projection 3 of the snap-fitting portion.

The obtained flexural elastic modulus P was 3.81 N (0.38 kgf).

Then, in order to calculate the probability at which the sealing member was unsatisfactorily engaged or disengaged when the sealing member was engaged with the main assembly of the image forming apparatus, or disengaged therefrom, the toner container fitted with the sealing member 2 was continuously and repeatedly mounted into the main assembly and removed therefrom, 100 times.

The results were: The toner supply container was correctly mounted and dismounted throughout the tests; it did not occur that the sealing member 2 was unsatisfactorily engaged or disengaged. In other words, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the following conditions: (1) bottle revolution: 40 rpm, (2) rotation interval: 3 seconds on, and 1 second off, and length of driving time: 70 hours.

The results were: After the duration test, it was detected that the base portion of the snap-fitting portion had permanently deformed by a very small amount. However, this deformation was so small that it did not present any problem at all in practical terms. Further, no breakage was detected, proving that even at the end of the duration test, the driving force was transmitted to the toner bottle just as satisfactorily as it was at the beginning of the test.

Incidentally, referring to FIG. 14, "flexural elastic modulus P" of the snap-fitting portion means the maximum amount of load (N) perpendicularly (direction indicated by arrow mark P) applied to the point of the latching projection 3 of the snap-fitting portion, immediately next to the engagement surface, in order to elastically deform the snap-fitting portion toward the axial line of the sealing member by a distance equal to the height h of the latching projection 3.

The method for measuring the flexural elastic modulus P, and the conditions under which the flexural elastic modulus was measured, were as follows: (1) measuring device: Compression-Tension Tester (Maker: Orientech, Model RTC-1225A), (2) down speed: 10 mm/sec.

The unit of the above described flexural elastic modulus P is in conformity with JIS-K7203 or ASTM-D 790.

Embodiment 2

<Sealing Member>

Material: ABS resin, maker & grade: Technopolymer (330), and flexural elastic modulus: 2,600 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottle similar to the one in the first embodiment was manufactured. Then, the combination of the two was subjected to the same test and evaluation used in the first embodiment.

The obtained flexural elastic modulus P was 7.08 N (0.72 kgf).

Then, in order to calculate the probability of unsatisfactory engagement or disengagement of the sealing member 2 during the mounting of the toner supply container 1 into the main assembly of the image forming apparatus, the container proper 1A fitted with the sealing member 2 was continuously and repeatedly mounted into the main assembly and removed therefrom, 100 times.

The results were: The sealing member 2 was correctly engaged or disengaged throughout the test; the unsatisfactory engagement or disengagement did not occur. In other words, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used for testing the sealing member in the first embodiment.

The results were: After the duration test, neither breakage nor permanent deformation of the snap-fitting portion was detected. In other words, even at the end of the test, the driving force was transmitted to the toner bottle just as satisfactorily as it was at the beginning of the tests.

Embodiment 3

The specifications of the sealing member in this embodiment were:

Material: ABS resin, maker & grade: Technopolymer (F5451G10), and flexural elastic modulus: 4,020 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottle similar to that in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of the snap-fitting portion in this embodiment was 10.95 N (1.11 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the tests.

Embodiment 4

The specifications of the sealing member in this fourth embodiment were:

Material: ABS resin, maker & grade: Technopolymer (130G20), and flexural elastic modulus: 5,590 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing members 2 with the above specifications were manufactured by injection molding, and also, a toner bottle similar to those in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of the snap-fitting portion in this embodiment was 15.22 N (1.55 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the tests.

Embodiment 5

The specifications of the sealing member in this fifth embodiment were:

Material: ABS resin, maker & grade: Idemitsu PPS (C-130SC), and flexural elastic modulus: 11,000 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottle similar to that in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of the snap-fitting portion in this embodiment was 29.96 N (3.06 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the tests.

Embodiment 6

The specifications of the sealing member in this sixth embodiment were:

Material: PPS resin, maker & grade: Idemitsu PPS (C160SL), and flexural elastic modulus: 20,000 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottles similar to that in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of the snap-fitting portion in this embodiment was 54.48 N (5.5 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the tests.

COMPARATIVE EXAMPLE 1

The specifications of the first comparative sealing member were:

Material: HD-PE resin, maker & grade: Kyoyo Polyethylene (M6940), and flexural elastic modulus: 1,100 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottle similar to that in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of this comparative example of the snap-fitting portion was 2.99 N (0.31 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: Five out of 100 times, the sealing member was unsatisfactorily engaged or disengaged. Thus, the probability of the unsatisfactory engagement or disengagement was 5%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, the base portions of two of the four snap-fitting portions had sustained cracks and/or more severe damages.

COMPARATIVE SEALING MEMBER 2

The specifications of the second comparative example of the sealing member were:

Material: PPS resin, maker & grade: Idemitsu PPS (C-600SG), and flexural elastic modulus: 23,000 MPa.

Measurements of snap-fitting portions: width b=5 mm; length L=21 mm; thickness t=2 mm; height h=2.5 mm; height H=2.75 mm; number of latching projections was four (see FIG. 10 for shape).

The sealing member 2 with the above specifications was manufactured by injection molding, and also, a toner bottle similar to that in the first embodiment was manufactured. Then, the combination of the sealing member 2 and toner bottle 1 was subjected to the same test and evaluation as those used for the sealing member 2 and toner bottle 1 in the first embodiment.

The flexural elastic modulus P of the snap-fitting portion in this comparative example of the sealing member was 62.6 N (6.38 kgf).

Then, in order to calculate the probability of the unsatisfactory engagement or disengagement of the sealing member during the mounting of the toner supply container into the main assembly of the image forming apparatus, or dismounting it therefrom, the container proper 1A fitted with the sealing member 2 was continuously and repeatedly mounted into the main assembly and removed therefrom, 100 times.

The results were: 24 out of 100 times, the sealing member 2 was unsatisfactorily engaged or disengaged. The reason for this unsatisfactory result seemed to be that this example of the sealing member was too high in flexural elastic modulus, being therefore too high in the rigidity of its snap-fitting portion for the sealing member to satisfactorily engage with the main assembly side.

Thus, the probability of the unsatisfactory engagement or disengagement was 24%.

Next, the toner bottle filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was satisfactorily transmitted to the toner bottle just as satisfactorily as it was at the beginning of the tests.

<Confirmation of Effects of Changes in Ratio of Width b to Length L on Performance of Sealing Member>

Next, the changes in the measurements of the various portions of the snap-fitting portion (more specifically, width b and length L) upon the flexural elastic modulus P, probability of unsatisfactory engagement or disengagement, and durability of the snap-fitting portion, were evaluated through the same tests as that to which the sealing member in the first embodiment was subjected. The summary of the results of these tests were given in FIG. 16. Hereafter, the test results of the sealing members in the seventh to tenth embodiments, and the test results of the third and fourth comparative examples of the sealing member will be described in order.

Embodiment 7

<Sealing Member>

The specifications of the sealing member in this seventh embodiment were:

Material: ABS resin, maker & grade: Technopolymer (330), and flexural elastic modulus: 2,600 MPa.

Measurements of snap-fitting portion: width b=5 mm; length L=10 mm; thickness t=2 mm; height h=2.5 mm; height H=2.75 mm; number of latching projections was four (see FIG. 10 for shape).

Thus, the ratio b/L of this sealing member was 0.5 (b/L=0.5).

The external diameter of the portion of the sealing member, on the toner outlet side, was 30.4 mm, and the diameter of the coupling portion (portion on driving portion side) of the sealing member was 20 mm.

<Container Proper>

The specifications of the container proper of the toner supply container were:

Material: HD-PS resin; bottle diameter=120 mm; bottle length=320 mm; and thickness=2 mm.

The toner bottle with the above specifications is manufactured by injection molding. To this bottles, a flange is welded, yielding the toner bottle shaped as shown in FIG. 6. Then, the sealing member 2 was pressed into the toner bottle. Then, the toner bottle was filled with 2,000 g of magnetic toner, yielding the final product.

First, in order to measure the flexural elastic modulus P of the sealing member 2, the sealing member was set in the compression-tension tester described below, and the flexural elastic modulus P of the snap-fitting portion was measured while applying load to the predetermined point (position indicated by arrow mark P) of the latching projection 3 of the snap-fitting portion, under the conditions shown in FIG. 14 by the amount enough to elastically deform the snap-fitting portion by the distance equal to the height h of the latching projection 3.

The thus obtained flexural elastic modulus P was 58 N (5.91 kgf).

Next, in order to calculate the probability of the unsatisfactory engagement or disengagement of the sealing member during the mounting of the toner supply bottle into the main assembly of the image forming apparatus, or the dismounting it therefrom, the toner container fitted with the sealing member 2 was continuously and repeatedly mounted into the main assembly and removed therefrom, 100 times.

The results were: The sealing member 2 was satisfactorily engaged and disengaged throughout the test; the unsatisfactory engagement or disengagement did not occur. In other words, the probability of the unsatisfactory engagement or disengagement was 0%.

Next, the toner bottle was filled with 2,000 g of toner, and was mounted into the main assembly of the image forming apparatus. Then, the durability of the snap-fitting portion was evaluated by driving the toner bottle, without discharging the toner, under the following conditions: (1) bottle revolution: 40 rpm, (2) rotation interval: 3 seconds on, and 1 second off, and (3) length of driving time: 70 hours.

The results were: After the duration test, it was detected that the base portion of the snap-fitting portion had permanently deformed by a very small amount. However, this deformation was so small that it did not present any problem at all in practical terms. Further, no breakage was detected, proving that even at the end of test, the driving force was transmitted to the toner bottle just as satisfactorily as it was at the beginning of the test.

Embodiment 8

<Sealing Member>

Material: ABS resin maker & grade: Technopolymer (330), and flexural elastic modulus: 2,600 MPa.

Measurements of snap-fitting portions: width b=5 mm; length L=15 mm; thickness t=2 mm; height h=2.5 mm; height H=2.75 mm; number of latching projections was four (see FIG. 10 for shape).

Thus, the ratio of the width b to the length L, of the sealing member was 0.333 (b/L=0.333).

The sealing member 2 with the above specifications was manufactured by injection molding, and also, a toner bottle similar to the one in the first embodiment was manufactured. Then, the combination of the two was evaluated through the same test as that used to evaluate the sealing member in the first embodiment.

The obtained flexural elastic modulus P of the snap-fitting portion was 19.4 N (1.98 kgf).

Then, in order to calculate the probability of unsatisfactory engagement or disengagement of the sealing member 2 during the mounting of the toner supply container 1 into the main assembly of the image forming apparatus, and the dismounting of it therefrom, the container proper 1A fitted with the sealing member 2 was continuously and repeatedly mounted into the main assembly and removed therefrom, 100 times.

The results were: The sealing member was satisfactorily engaged and disengaged throughout the test; the unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used for testing the sealing member in the first embodiment.

The results were: After the duration test, neither breakage nor permanent deformation of the snap-fitting portion was detected, proving that even at the end of the test, the driving force was transmitted to the toner bottle just as satisfactorily as it was at the beginning of the test.

Embodiment 9

The specifications of the sealing member in this ninth embodiment were:

Material: ABS resin, maker & grade: Technopolymer (330), and flexural elastic modulus: 2,600 MPa.

Measurements of snap-fitting portions: width b=5 mm; length L=25 mm; thickness t=2 mm; height h=2.5 mm; height H=2.75 mm; number of latching projections was four (see FIG. 10 for shape).

Thus, the ratio b/L of this sealing member was 0.20 (b/L=0.20).

The sealing members 2 with the above specifications were manufactured by injection molding, and also, a toner bottle similar to that in the first embodiment was manufactured. Then, the combination of the sealing member 2 and toner bottle 1 was evaluated through the same test as the test used for the sealing member 2 and toner bottle 1 in the first embodiment.

The flexural elastic modulus P of the snap-fitting portion in this embodiment was 4.19 N (0.43 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member was satisfactorily engaged and disengaged throughout the test; unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the test.

Embodiment 10

The specifications of the sealing member in this tenth embodiment were:

Material: ABS resin, maker & grade: Technopolymer (330), and flexural elastic modulus: 2,600 MPa.

Measurements of snap-fitting portions: width b=5 mm; length L=45 mm; thickness t=2 mm; height h=2.5 mm; height H=2.75 mm; number of latching projections was four (see FIG. 10 for shape).

Thus, the ratio b/L was 0.111 (b/L=0.111).

The sealing member 2 with the above specifications was manufactured by injection molding, and also, a toner bottle similar to those in the first embodiment was manufactured. Then, the combination of the sealing member 2 and toner bottle 1 was evaluated through the same test as that used for the sealing member 2 and toner bottle 1 in the first embodiment.

The flexural elastic modulus P of the snap-fitting portion in this embodiment was 0.72 N (0.07 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member 2 was satisfactorily engaged or disengaged throughout the test; unsatisfactory engagement or disengagement did not occur. Thus, the probability of the unsatisfactory engagement or disengagement was 0%.

Next, the toner bottle was filled with 2,000 g of toner was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, very slight deformation was detected at the base portion of the snap-fitting portion. But, this deformation was small enough to present no problem in practical terms. Further, no breakage was found. Thus, even at the end of the test, the driving force was transmitted to the toner bottle just as satisfactorily as it was at the beginning of the test.

COMPARATIVE EXAMPLE 3

The specifications of the third comparative sealing member were:

Material: ABS resin, maker & grade: Technopolymer (330), and flexural elastic modulus: 2,600 MPa.

Measurements of snap-fitting portions: width b=5 mm; length L=5 mm; thickness t=2 mm; height h=2.5 mm; height H=2.75 mm; number of latching projections was four (see FIG. 10 for shape).

Thus, the ratio b/L of the sealing member was 1.00 (b/L=1.00).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment.

The flexural elastic modulus P of this comparative example of the snap-fitting portion was 524.7 N (53.5 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: This sealing member was too high in flexural elastic modulus in order for the sealing member to satisfactorily engage with the main assembly side. Thus, the probability of the unsatisfactory engagement or disengagement was 100%.

Next, the toner bottle was filled with 2,000 g of toner and was mounted into the main assembly of the image forming apparatus. Then, an attempt was made to evaluate the durability of the snap-fitting portion by driving the toner bottle, without discharging the toner, under the same conditions as those used to test the sealing member in the first embodiment. However, this sealing member could not be evaluated in durability, because it did not engage.

COMPARATIVE EXAMPLE 4

The specifications of the fourth comparative sealing member were:

Material: ABS resin, maker & grade: Technopolymer (330), and flexural elastic modulus: 2,600 MPa.

Measurements of snap-fitting portions: width b=5 mm; length L=50 mm; thickness t=2 mm; height h=2.5 mm; height H=2.75 mm; number of latching projections was four (see FIG. 10 for shape).

Thus, the ratio b/L of this sealing member was 0.10 (b/L=0.10).

The sealing member 2 with the above specifications was manufactured by injection molding, and also, a toner bottle similar to that in the first embodiment were manufactured. Then, the combination of the sealing member 2 and toner bottle 1 was evaluated through the same test as that used for the sealing member 2 and toner bottle 1 in the first embodiment.

The flexural elastic modulus P of this comparative example of the snap-fitting portion was 0.52 N (0.05 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member was correctly engaged and disengaged throughout the tests. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After roughly an hour or so into the duration test, the toner bottle stopped rotating. The investigation into the cause of this stoppage revealed that the base portion of the snap-fitting portion was completely broken, dissolving the engagement of the sealing member with the driving portion 20 of the apparatus main assembly 100. In other words, the investigation revealed that the sealing member was not in the condition to receive the driving force.

<Confirmation of Effects of Changes in Ratio of Thickness t to Length L>

Next, the changes in the measurements of the various portions of the snap-fitting portion (more specifically, thickness t and length L) upon the flexural elastic modulus, probability of unsatisfactory engagement or disengagement, and durability of the snap-fitting portion, were evaluated through the same test as that the sealing member in the first embodiment was subjected. The summary of the results of this test were given in FIG. 17. Hereafter, the test results of the sealing members in the eleventh to fourteenth embodiments, and the test results of the fifth and sixth comparative examples of the sealing member will be described in order.

Embodiment 11

<Sealing Member>

The specification of the sealing member in this seventh embodiment were:

Material: ABS resin, maker & grade: Technopolymer (330), and flexural elastic modulus: 2,600 MPa.

Measurements of snap-fitting portions: width b=5 mm; length L=21 mm; thickness t=1 mm; height h=2.5 mm; height H=2.75 mm; number of latching projections was four (see FIG. 10 for shape). Thus, the ratio t/L of this sealing member was 0.071 (t/L=0.071).

The external diameter of the portion of the sealing member, on the toner outlet side, was 30.4 mm, and the diameter of the coupling portion (portion on driving portion side) of the sealing member was 20 mm.

<Container Proper>

The specifications of the container proper of the toner supply container were:

Material: HI-PS resin; bottle diameter=120 mm; bottle length=320 mm; and thickness=2 mm.

The toner bottle with the above specifications was manufactured by injection molding. To this bottle, a flange was welded, yielding the toner bottle shaped as shown in FIG. 6. Then, the sealing member 2 was pressed into the toner bottle. Then, the toner bottle was filled with 2,000 g of magnetic toner, yielding the final product of the toner bottle.

First, in order to measure the flexural elastic modulus P of the sealing member 2, the sealing member was set in the compression-tension tester described below, and the flexural elastic modulus P of the snap-fitting portion was measured while applying load to the predetermined point (position indicated by arrow mark P) of the latching projection of the snap-fitting portion, under the conditions shown in FIG. 14 by the amount enough to elastically deform the snap-fitting portion by the distance equal to the height h of the latching projection 3. The thus obtained flexural elastic modulus P was 1.79 N (0.18 kgf).

Next, in order to calculate the probability of the unsatisfactory engagement or disengagement of the sealing member during the mounting of the toner supply bottle into the main assembly of the image forming apparatus, or the dismounting it therefrom, the toner container fitted with the sealing member 2 was continuously and repeatedly mounted into the main assembly and removed therefrom, 100 times.

The results were: The sealing member 2 was satisfactorily engaged and disengaged throughout the test; the unsatisfactory engagement or disengagement did not occur. In other words, the probability of the unsatisfactory engagement or disengagement was 0%.

Next, the toner bottle was filled with 2,000 g of toner, and was mounted into the main assembly of the image forming apparatus. Then, the durability of the snap-fitting portion was evaluated by driving the toner bottle, without discharging the toner, under the following conditions: (1) bottle revolution: 40 rpm, (2) rotation interval: 3 seconds on, and 1 second off, and (3) length of driving time: 70 hours.

The results were: After the duration tests, it was detected that the base portion of the snap-fitting portion had deformed by a very small amount. However, this deformation was so small that it did not present no problem at all in practical terms. Further, no breakage was detected, proving that even at the end of test, the driving force was transmitted to the toner bottle just as satisfactorily as it was at the beginning of the test.

Embodiment 12

The specifications of the sealing member is this twelfth embodiment were:

Material: ABS resin maker & grade: Technopolymer (330), and flexural elastic modulus: 2,600 MPa.

Measurements of snap-fitting portions: width b=5 mm; length L=21 mm; thickness t=2 mm; height h=2.5 mm; height H=2.75 mm; number of latching projections was four (see FIG. 10 for shape). Thus, the ratio of the thickness t to the length L, of the sealing member was 0.095 (t/L=0.0095).

The sealing member 2 with the above specifications was manufactured by injection molding, and also, a toner bottle similar to the one in the first embodiment was manufactured. Then, the combination of the two was evaluated through the same test as that used to evaluate the sealing member in the first embodiment. The obtained flexural elastic modulus P of the snap-fitting portion was 5.66 N (0.58 kgf).

Then, in order to calculate the probability of unsatisfactory engagement or disengagement of the sealing member 2 during the mounting of the toner supply container 1 into the main assembly of the image forming apparatus, and the dismounting of it therefrom, the container proper 1A fitted with the sealing member 2 was continuously and repeatedly mounted into the main assembly and removed therefrom, 100 times.

The results were: The sealing member was correctly engaged and dismounted throughout the test; the unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used for testing the sealing member in the first embodiment.

The results were: After the duration test, neither breakage nor permanent deformation of the snap-fitting portion was detected, proving that even at the end of the test, the driving force was transmitted to the toner bottle just as satisfactorily as it was at the beginning of the test.

Embodiment 13

The specifications of the sealing member in this thirteenth embodiment were:

Material: ABS resin, maker & grade: Technopolymer (330), and flexural elastic modulus: 2,600 MPa.

Measurements of snap-fitting portions: width b=5 mm; length L=21 mm; thickness t=2.5 mm; height h=2.5 mm; height H=2.75 mm; number of latching projections was four (see FIG. 10 for shape). Thus, the ratio t/L of this sealing member was 0.119 (t/L=0.119).

The sealing member 2 with the above specifications was manufactured by injection molding, and also, a toner bottle similar to that in the first embodiment was manufactured. Then, the combination of the sealing member 2 and toner bottle 1 was evaluated through the same test as the test used for the sealing member 2 and toner bottle 1 in the first embodiment. The flexural elastic modulus P of the snap-fitting portion in this embodiment was 11.08 N (1.13 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member was correctly engaged and disengaged throughout the test; unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the test.

Embodiment 14

The specifications of the sealing member in this fourteenth embodiment were:

Material: ABS resin, maker & grade: Technopolymer (330), and flexural elastic modulus: 2,600 MPa.

Measurements of snap-fitting portions: width b=5 mm; length L=21 mm; thickness t=3.0 mm; height h=2.5 mm; height H=2.75 mm; number of latching projections was four (see FIG. 10 for shape). Thus, the ratio t/L was 0.143 (t/L=0.143).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of the snap-fitting portion in this embodiment was 19.14 N (1.95 kgf).

Then, in order to calculate the probability of the unsatisfactory engagement or disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration tests, neither damage nor deformation of the snap-fitting portion was detected, proving that even at the end of the test, the driving force was transmitted to the toner bottle just as satisfactorily as it was at the beginning of the tests.

COMPARATIVE EXAMPLE 5

The specifications of the fifth comparative sealing member were:

Material: ABS resin, maker & grade: Technopolymer (330), and flexural elastic modulus: 2,600 MPa.

Measurements of snap-fitting portions: width b=5 mm; length L=21 mm; thickness t=1.0 mm; height h=2.5 mm; height H=2.75 mm; number of latching projections was four (see FIG. 10 for shape). Thus, the ratio t/L of the sealing member was 0.048 (t/L=0.048).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of this comparative example of the snap-fitting portion was 0.7 N (0.07 kgf).

Then, in order to calculate the probability of the unsatisfactory engagement and disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: This sealing member was correctly engaged and disengaged; the unsatisfactory engagement or disengagement did not occur. Thus, the probability of the unsatisfactory engagement and disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After roughly 1.5 hours or so into the durability test, the toner bottle stopped rotating. The investigation into the cause of this stoppage revealed that the base portion of the snap-fitting portion was completely broken, dissolving the engagement of the sealing member with the driving portion 20 of the apparatus main assembly 100. In other words, the investigation revealed that the sealing member was not in the condition to receive the driving force.

COMPARATIVE EXAMPLE 6

The specification of the sixth comparative sealing member:

Material: ABS resin, maker & grade: Technopolymer (330), and flexural elastic modulus: 2,600 MPa.

Measurements of snap-fitting portions: width b=5 mm; length L=21 mm; thickness t=5.0 mm; height h=2.5 mm; height H=2.75 mm; number of latching projections was four (see FIG. 10 for shape). Thus, the ratio t/L of this sealing member was 0.238 (t/L=0.238).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of this comparative example of the snap-fitting portion was 88.6 N (9.04 kgf).

Then, in order to calculate the probability of the unsatisfactory engagement and disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: This sealing member was too high in flexural elastic modulus, being therefore very difficult to engage with the main assembly of the image forming apparatus. More specifically, the unsatisfactory engagement occurred 85 out of 100 times.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither damage nor deformation of the snap-fitting portion was detected, proving that even at the end of the test, the driving force was transmitted to the toner bottle just as satisfactorily as it was at the beginning of the test.

<Confirmation of Effects of Changes in Height h to Length L>

Next, the changes in the measurements of the various portions of the snap-fitting portion (more specifically, height h and length L) upon the flexural elastic modulus, probability of unsatisfactory engagement and disengagement, and durability of the snap-fitting portion, were evaluated through the same test as that to which the sealing member in the first embodiment was subjected. The summary of the results of this test was given in FIG. 18. Hereafter, the test results of the sealing members in the fifteenth to eighteenth embodiments, and the test results of the seventh and eighth comparative examples of the sealing member will be described in order.

Embodiment 15

<Sealing Member>

The specifications of the sealing member in this fifteenth embodiment were:

Material: ABS resin, maker & grade: Technopolymer (330), and flexural elastic modulus: 2,600 MPa.

Measurements of snap-fitting portions: width b=5 mm; length L=21 mm; thickness t=2.0 mm; height h=2.5 mm; height H=2.75 mm; number of latching projections was four (see FIG. 10 for shape). Thus, the ratio h/L of this sealing member was 0.119 (h/L=0.119).

The external diameter of the portion of the sealing member, on the toner outlet side, was 30.4 mm, and the diameter of the coupling portion (portion on driving portion side) of the sealing member was 20 mm.

<Container Proper>

The specifications of the container proper of the toner supply container were:

Material: HI-PS resin; bottle diameter=120 mm; bottle length=320 mm; and wall thickness=2 mm.

The cylindrical toner bottle with the above specifications was manufactured by injection molding. To this bottle, a flange was welded, yielding the toner bottle shaped as shown in FIG. 6. Then, the sealing member 2 was pressed into the toner bottle. Then, the toner bottle was filled with 2,000 g of magnetic toner, yielding the final product.

First, in order to measure the flexural elastic modulus P of the sealing member 2, the sealing member was set in the compression-tension tester described below, and the flexural elastic modulus P of the snap-fitting portion was measured by applying load to the predetermined point (position indicated by arrow mark P) of the latching projection 3 of the snap-fitting portion, under the conditions shown in FIG. 14, by the amount enough to elastically deform the snap-fitting portion by the distance equal to the height h of the latching projection 3. The thus obtained flexural elastic modulus P was 7.08 N (0.72 kgf).

Next, in order to calculate the probability of the unsatisfactory engagement or disengagement of the sealing member during the mounting of the toner supply bottle into the main assembly of the image forming apparatus, or the dismounting of it therefrom, the toner container fitted with the sealing member 2 was continuously and repeatedly mounted into the main assembly and removed therefrom, 100 times.

The results were: The sealing member 2 was correctly engaged and disengaged throughout the test; the unsatisfactory engagement or disengagement did not occur. In other words, the probability of the unsatisfactory engagement or disengagement was 0%.

Next, the toner bottle was filled with 2,000 g of toner, and was mounted into the main assembly of the image forming apparatus. Then, the durability of the snap-fitting portion was evaluated by driving the toner bottle, without discharging the toner, under the following conditions: (1) bottle revolution: 40 rpm, (2) rotation interval: 3 seconds on, and 1 second off, and (3) length of driving time: 70 hours.

The results were: After the duration test, it was detected that the base portion of the snap-fitting portion had permanently deformed by a very small amount. However, this deformation was so small that it did not present any problem at all in practical terms. Further, no breakage was detected, proving that even at the end of test, the driving force was transmitted to the toner bottle just as satisfactorily as it was at the beginning of the test.

Embodiment 16

The specifications of the sealing member is this sixteenth embodiment were:

Material: ABS resin maker & grade: Technopolymer (330), and flexural elastic modulus: 2,600 MPa.

Measurements of snap-fitting portions: width b=5 mm; length L=21 mm; thickness t=2 mm; height h=1.0 mm; height H=2.75 mm; number of latching projections was four (see FIG. 10 for shape). Thus, the ratio of the height h to the length L, of the sealing member was 0.048 (h/L=0.048).

The sealing member 2 with the above specifications was manufactured by injection molding, and also, a toner bottle similar to the one in the first embodiment was manufactured. Then, the combination of the two was evaluated through the same test as that used to evaluate the sealing member in the first embodiment. The obtained flexural elastic modulus P of the snap-fitting portion was 2.83 N (0.28 kgf).

Then, in order to calculate the probability of unsatisfactory engagement and disengagement of the sealing member 2 during the mounting of the toner supply container 1 into the main assembly of the image forming apparatus, and the dismounting of it therefrom, the container proper 1A fitted with the sealing member 2 was continuously and repeatedly mounted into the main assembly and removed therefrom, 100 times.

The results were: The sealing member was correctly engaged and dismounted throughout the test; the unsatisfactory engagement or disengagement did not occur. Thus, the probability of the unsatisfactory engagement or disengagement was 0%.

Next, the toner bottle was filled with 2,000 g of toner, and was mounted into the main assembly of the image forming apparatus. Then, the durability of the snap-fitting portion was evaluated by driving the toner bottle, without discharging the toner, under the same conditions as those used for testing the sealing member in the first embodiment.

The results were: After the duration test, neither breakage nor permanent deformation of the snap-fitting portion was detected, proving that even at the end of test, the driving force was transmitted to the toner bottle just as satisfactorily as it was at the beginning of the test.

Embodiment 17

The specifications of the sealing member in this thirteenth embodiment were:

Material: ABS resin, maker & grade: Technopolymer (330), and flexural elastic modulus: 2,600 MPa.

Measurements of snap-fitting portions: width b=5 mm; length L=21 mm; thickness t=2 mm; height h=4.0 mm; height H=2.75 mm; number of latching projections was four (see FIG. 10 for shape). Thus, the ratio h/L of this sealing member was 0.19 (h/L=0.19).

The sealing member 2 with the above specifications was manufactured by injection molding, and also, a toner bottle similar to that in the first embodiment was manufactured. Then, the combination of the sealing member 2 and toner bottle 1 was evaluated through the same test as the test used for the sealing member 2 and toner bottle 1 in the first embodiment. The flexural elastic modulus P of the snap-fitting portion in this embodiment was 11.3 N (1.15 kgf).

Then, in order to calculate the probability of the unsatisfactory engagement and disengagement of during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member was correctly engaged and disengaged throughout the test; unsatisfactory engagement or disengagement did not occur. Thus, the probability of the unsatisfactory engagement or disengagement was 0%.

Next, the toner bottle was filled with 2,000 g of toner, and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither the breakage nor permanent deformation of the snap-fitting portion was detected, proving that even at the end of the test, the driving force was transmitted to the toner bottle just as satisfactorily as it was at the beginning of the test.

Embodiment 18

The specifications of the sealing member in this eighteenth embodiment were:

Material: ABS resin, maker & grade: Technopolymer (330), and flexural elastic modulus: 2,600 MPa.

Measurements of snap-fitting portions: width b=5 mm; length L=21 mm; thickness t=2 mm; height h=5.0 mm; height H=2.75 mm; number of latching projections was four (see FIG. 10 for shape). Thus, the ratio h/L was 0.238 (h/L=0.238).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of the snap-fitting portion in this embodiment was 14.16 N (1.44 kgf).

Then, in order to calculate the probability of the unsatisfactory engagement and disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The sealing member 2 was correctly engaged and disengaged throughout the test; unsatisfactory engagement or disengagement did not occur. Thus, the probability of the unsatisfactory engagement or disengagement was 0%.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: After the duration test, neither breakage nor permanent deformation of the snap-fitting portion was detected, proving that even at the end of the test, the driving force was transmitted to the toner bottle just as satisfactorily as it was at the beginning of the test.

COMPARATIVE EXAMPLE 7

The specifications of the seventh comparative sealing member were:

Material: ABS resin, maker & grade: Technopolymer (330), and flexural elastic modulus: 2,600 MPa.

Measurements of snap-fitting portions: width b=5 mm; length L=21 mm; thickness t=2 mm; height h=0.5 mm; height H=2.75 mm; number of latching projections was four (see FIG. 10 for shape). Thus, the ratio h/L of the sealing member was 0.024 (h/L=0.024)

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of this comparative example of the snap-fitting portion was 1.41 N (0.14 kgf).

Then, in order to calculate the probability of the unsatisfactory engagement and disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: The unsatisfactory engagement or disengagement of the sealing member occurred 64 times out of 100 times. The causes for this unsatisfactory result seemed to be that this example of the sealing member was too small in the vertical dimension of the height h of the latching projection, and therefore, the sealing member could not engage with the driving portion 20 of the main assembly.

Next, the toner bottle was filled with 2,000 g of toner and was mounted into the main assembly of the image forming apparatus. Then, the durability of the snap-fitting portion was evaluated by driving the toner bottle, without discharging the toner, under the same conditions as those used to test the sealing member in the first embodiment.

The results were: From the beginning of the durability test, the rotation of the toner bottle was very unstable; sometimes the toner bottle rotated, and other times, it did not- rotate. After roughly 1.5 hours or so into the durability test, the toner bottle stopped rotating. The cause for this seemed to be that the height h of the latching projection was too low for the latching projection to remain properly latched with the driving portion 20 of the main assembly.

COMPARATIVE EXAMPLE 8

The specifications of the eighth comparative sealing member were:

Material: ABS resin, maker & grade: Technopolymer (330), and flexural elastic modulus: 2,600 MPa.

Measurements of snap-fitting portions: width b=5 mm; length L=10 mm; thickness t=2 mm; height h=5.0 mm; height H=2.75 mm; number of latching projections was four (see FIG. 10 for shape). Thus, the ratio h/L of this sealing member was 0.50 (h/L=0.50).

The sealing member 2 with the above specifications was manufactured by injection molding, and also, a toner bottle similar to that in the first embodiment was manufactured. Then, the combination of the sealing member 2 and toner bottle 1 was evaluated through the same test as that used for the sealing member 2 and toner bottle 1 in the first embodiment. The flexural elastic modulus P of this comparative example of the snap-fitting portion was 131.1 N (13.3 kgf).

Then, in order to calculate the probability of the unsatisfactory engagement and disengagement of the sealing member during the mounting of the toner supply container into the main assembly of the image forming apparatus, or dismounting of it therefrom, the container proper 1A fitted with the sealing member 2 was continuously and repeatedly mounted into the main assembly and removed therefrom, 100 times.

The results were: This sealing member was too high in flexural elastic modulus for the sealing member to engage with the main assembly; the sealing member did not engage with the main assembly at all. Thus, the probability of the unsatisfactory engagement or disengagement was 100%.

Next, the toner bottle was filled with 2,000 g of toner and was mounted into the main assembly of the image forming apparatus. Then, an attempt was made to evaluate the durability of the snap-fitting portion by driving the toner bottle, without discharging the toner, under the same conditions as those used to test the sealing member in the first embodiment. However, this sealing member could not be evaluated in durability, because it did not engage.

[Results of Confirmation]

It is evident from the results of the confirmation tests given above that the mechanical properties of the sealing member are desired to satisfy the following conditions:

Regarding the flexural elastic modulus of the sealing member, when it was too low (no more than 1,100 MPa) as that of the first comparative example of the sealing member, the unsatisfactory engagement or disengagement occurred. Contrarily, the unsatisfactory engagement or disengagement also occurred, when it was extremely high (no less than 23,000 Mps) as that of the second comparative example of the sealing member. As will be evident from FIG. 15, when the flexural elastic modulus was in the aforementioned range in the first to sixth embodiments, the unsatisfactory engagement or disengagement did not occur; it was satisfactory. Thus, it is clear that as the material for the sealing member, a substance capable of providing the snap-fitting portion with a flexural elastic modulus value within the range of 1,400–20,000 MPa, preferably, the range of 2,600–5,590 MPa, or the range in the second to fourth embodiments, is desirable. This is because when the flexural elastic modulus of the snap-fitting portion is within the aforementioned range in the second to fourth embodiments, there is a good balance between the durability and unsatisfactory engagement or disengagement, even though the flexural elastic modulus is smaller. When the flexural elastic modulus is in the range in fifth and sixth embodiments, there is no problem in terms of practicality, and the sealing member is excellent in durability. However, the amount of the force necessary to elastically deform the snap-fitting portion of the sealing member is in the range of 29.96–54.48 N, which is relatively high compared to the range in which the amount of the force necessary to elastically deform the snap-fitting portion of the sealing members in the first to fourth embodiments. Therefore, the force necessary to mount or dismount the toner supply container is relatively high. Thus, from the standpoint that as long as the snap-fitting portion of the sealing member is satisfactory in terms of durability, the amount of the force necessary to elastically deform the snap-fitting portion is desired to be as small as possible, the preferable range is 2,600–5,590 MPa.

Regarding the ratio (b/L) between the width b and length L, when the width b was equal to the length L (b/L=1) as in the case of the third comparative example of the sealing member, or the width b was greater than the length L, the snap-fitting portion was too rigid for the snap-fitting portion to engage with the driving portion 20 of the main assembly; unsatisfactory mounting occurred. On the contrary, when the length L was greater by an extremely large amount than the width b as in the case of the fourth comparative example of the sealing member (b/L=0.1), the snap-fitting portion was too low in rigidity to withstand the rotational torque from the driving portion 20; the snap-fitting portion broke at the base, failing to satisfactorily transmit the driving force. As will be evident also from FIG. 16, when the ratio of the width b to the length L was within the abovementioned range in the seventh to tenth embodiments, the unsatisfactory engagement or disengagement, and unsatisfactory transmission of the driving force, did not occur; in other words, the snap-fitting portion functioned satisfactorily. Therefore, it is evident that the ratio between the width b and length L is desired to be in the range of 0.11–0.5 (b/L=0.11–0.5).

As for the ratio of the thickness t to the length L (t/L), when it was too small as in the case of the fifth comparative example of the sealing member (t/L=0.048), the snap-fitting portion was too small in rigidity for the driving force to be satisfactorily transmitted. On the contrary, when the ratio of the thickness t to the length L was extremely large as in the case of the sixth comparative example (t/L=0.238), the snap-fitting portion was too high in rigidity to be easily and elastically deformed. Therefore, the unsatisfactory engagement or disengagement occurred. As will be understood from FIG. 17, when the ratio of thickness t to the length L is in the aforementioned range in the eleventh to fourteenth embodiments, the unsatisfactory engagement or disengagement did not occur, and therefore, the unsatisfactory transmission of the driving force did not occur. In other words, the sealing member was satisfactorily functioning. Therefore, it is clear that the ratio of thickness t to the length L is desired to be in the range of 0.05–0.15 (t/L=0.05–0.15).

As for the ratio of the height h to the length L (h/L), when it was too small as in the case of the seventh comparative example (h/L=0.024), the snap-fitting portion could not remain latched with the driving portion 20 of the main assembly, allowing thereby the sealing member to slip against the driving portion. Therefore, the unsatisfactory transmission of the driving force occurred. On the contrary, when the ratio of height h to the length L is extremely large as in the case of the eighth comparative example (h/L=0.5), the snap-fitting portion was too high in rigidity to be easily deformed in the elastic manner. Therefore, the unsatisfactory engagement or disengagement occurred. As will be evident also from FIG. 8, the unsatisfactory engagement or disengagement did not occur when the ratio of height h to the length L was in the aforementioned range in the fifteenth to eighteenth embodiments; the engagement and disengagement were satisfactory. Therefore, it is clear that the ratio of the height h to the length L is desired to be in the range of 0.04–0.25 (h/L=0.04–0.25).

As described above, according to the present invention, the flexural elastic modulus of the snap-fitting portion is set to a value within the above described range. Therefore, the snap-fitting portion is satisfactorily and reliably snap-fitted with the driving portion of the apparatus main assembly, and the rotational driving force is reliably received from the driving portion of the apparatus main assembly. Therefore, it is possible to realize a developer supply container which is superior in terms of the operation for supplying the developer, and also, in terms of the reliability with which the container is mounted or dismounted, and therefore, does not burden an operator.

Miscellaneous Embodiments

In the above described embodiments, both the rotational force receiving portion and engagement force bearing portion are integral parts of the latching projection 3. These embodiments are not intended to limit the scope of the present invention. For example, the projection for receiving the rotational driving force from the driving portion of the main assembly of an image forming apparatus, and the projection for bearing the force applied from the driving portion of the image forming apparatus main assembly in the thrust direction (direction parallel to axial line of sealing member), may be made independent from each other. Also in the above described embodiments, the snap-fitting portion, which engages with the driving portion of the apparatus main assembly, was integral with the sealing portion. However, the sealing portion may be made independent from the snap-fitting portion.

Also in the above described embodiments, the number of the developer supply containers 1 removably mountable in the image forming apparatus was one. However, these embodiments are not intended to limit the number of the developer supply containers to one. It may be optionally set as necessary. Further, in the above described embodiments, the image forming apparatus was an image forming apparatus capable of only monochromatic images. However, these embodiments are not intended to limit the application of the present invention to an image forming apparatus capable of recording only monochromatic images. That is, the present invention is also compatible with an image forming apparatus capable of color images. In other words, the application of the present invention to a developer supply container removably mountable in such an image forming apparatus, and the sealing member therefor, yields the same effects as those obtained by the sealing members in the above described embodiments.

Also in the above described embodiments, the image forming apparatus was a copying machine. However, these embodiments are not intended to limit the application of the present invention to a copying machine. Rather, the present invention is also compatible with other image forming apparatuses than a copying machine, for example, a printer, a facsimileing machine, and multifunction image forming apparatus capable of performing various combinations of the functions of the preceding apparatuses. Further, not only is the present invention compatible with the image forming apparatus in the preceding embodiments, but also, an image forming apparatus which employs a transfer medium bearing member, and in which toner images different in color are sequentially transferred in layers onto a transfer medium borne on the transfer medium bearing member; an image forming apparatus which employs an intermediary transferring member, and in which toner images different in color are sequentially transferred in layers, and then, the toner images borne on the intermediary transferring member are transferred all at once onto a transfer medium. In other words, the application of the present invention to the developer supply container removably mountable in such image forming apparatuses, and the sealing member therefor, will yield the same effects as those obtained by the preceding embodiments.

Also in the above described embodiments, the sealing member is made to function also as a member for transmitting the driving force. However, these embodiments are not intended to limit the scope of the present invention. That is, the present invention may be embodied in a form different from the preceding embodiments. For example, the container proper of the toner supply container may be provided with a driving force transmitting member independent from the sealing member. Such an embodiment yields the same effects as those yielded by the preceding embodiments.

Further, regarding one of the effects which characterize the above described sealing member, in the case of a sealing member in accordance with the prior art, it is possible that the snap-fitting portion will disengage because of the reactive force generated by the force applied to move the sealing member during the unsealing of a toner supply container. In the case of the sealing member in accordance with the present invention, however, such disengagement of the snap-fitting portion can be prevented as long as the flexural elastic modulus is within the above described range.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Application No. 425721/2003 filed Dec. 22, 2003, which is hereby incorporated by reference.

What is claimed is:

1. A developer supply container detachably mountable to an image forming apparatus, said developer supply container comprising:

a discharge opening for permitting discharging of a developer;

a container body for accommodating the developer;

a snap hook member having an engaging projection for snap-hook engagement with an engageable member of the image forming apparatus;

a feeding portion for feeding the developer from said container toward said discharge opening by a rotating force received by said engaging projection from the engageable member;

wherein snap hook member has a bending modulus of 1400–20000 MPa.

2. A developer supply container according to claim 1, wherein snap-hook member has a bending modulus of 2600–5590 MPa.

3. A developer supply container according to claim 1 or 2, wherein said snap-hook member has a movable portion on which said engaging projection is provided, and wherein a ratio b/L of a width b of said engaging projection to a length L of the movable portion is 0.11–0.5.

4. A developer supply container according to claim 1 or 2, wherein said snap-hook member has a movable portion on which said engaging projection is provided, and wherein a ratio t/L of a thickness t of said engaging projection to a length L of the movable portion is 0.05–0.15.

5. A developer supply container according to claim 1 or 2, wherein said snap-hook member has a movable portion on which said engaging projection is provided, and wherein a ratio h/L of a height h of said engaging projection a length L of the movable portion is 0.04–0.25.

6. A developer supply container according to claim 1 or 2, wherein said snap-hook member has a movable portion on which said engaging projection is provided, and wherein a ratio b/L of a width b of said engaging projection to a length L of the movable portion is 0.11–0.5, wherein a ratio t/L of a thickness t of said engaging projection to a length L of the movable portion is 0.05–0.15, and wherein a ratio h/L of a height h of said engaging projection a length L of the movable portion is 0.04–0.25.

7. A developer supply container according to claim 1 or 2, wherein said snap-hook member has a force receiving portion for receiving a force in a direction of a rotational axis from said engageable member to open and close said discharge opening.

8. A developer supply container according to claim 7, wherein said snap-hook member has a sealing portion for sealing said discharge opening, and the force received by said force receiving portion imparts a relative movement between said sealing portion and said container body.

9. A developer supply container according to claim 7, wherein said force receiving portion is provided on said engaging projection.

10. A developer supply container according to claim 1, wherein said snap-hook member has a releasing projection for receiving, from a hollow cylindrical member provided in the image forming apparatus, a force for displacement said engaging projection to release the snap-hook engagement with said engageable member.

11. A developer supply container according to claim 1, wherein said snap-hook member has a transmitting portion for transmitting the rotating force to the container.

12. A developer supply container according to claim 11, wherein said feeding portion has a plate-like member fixed on said container, and a projection provided inclined relative to the rotational axis on the plate-like member.

13. A developer supply container according to claim 11, wherein said feeding portion has a projection provided and extended helically on an inner surface of said container body.

* * * * *

UNITED STATES PATENT AND TRADEMARK OFFICE

CERTIFICATE OF CORRECTION

PATENT NO. : 7,155,138 B2
APPLICATION NO. : 11/012175
DATED : December 26, 2006
INVENTOR(S) : Yusuke Yamada It is certified that error appears in the above-identified patent and that said Letters Patent is hereby corrected as shown below:

COLUMN 5:
Line 54, “invention is” should read --invention--.

COLUMN 6:
Line 63, “la” should read --1a--.

COLUMN 7:
Line 50, “to” should read --to be--.

COLUMN 8:
Line 60, “ain” should read --a in--.
Line 64, “ain” should read --a in--.

COLUMN 9:
Line 18, “aor” should read --a or--.
Line 30, “lo” should be deleted.

COLUMN 10:
Line 56, “proper 1a.” should read --proper 1A.--.

COLUMN 18:
Line 12, “a a” should read --a--.

COLUMN 22:
Line 66, “measure” should read --measured--.

COLUMN 26:
Line 25, “bottles” should read --bottle--.

COLUMN 28:
Line 53, “bottles,” should read --bottle,--.

COLUMN 33:
Line 3, “seventh” should read --eleventh--.
Line 63, “no problem” should read --any problem--.

COLUMN 38:
Line 39, “is” should read --in--.

UNITED STATES PATENT AND TRADEMARK OFFICE

CERTIFICATE OF CORRECTION

PATENT NO. : 7,155,138 B2
APPLICATION NO. : 11/012175
DATED : December 26, 2006
INVENTOR(S) : Yusuke Yamada It is certified that error appears in the above-identified patent and that said Letters Patent is hereby corrected as shown below:

COLUMN 39:
Line 13, “thirteenth” should read --seventeenth--.

COLUMN 40:
Line 40, “(h/L=0.024)” should read --(h/L=0.024).--.

COLUMN 41:
Line 6, “not-rotate.” should read --not rotate.--.

COLUMN 44:
Line 60, “snap hook” should read --snap-hook--.

COLUMN 45:
Line 1, “snap hook member” should read --said snap-hook member--.
Line 4, “snap-hook member” should read --said snap-hook member--.
Line 28, “projection” should read --projection to--.

COLUMN 46:
Line 15, “displacements” should read --displacing--.

Signed and Sealed this

Fourth Day of September, 2007

JON W. DUDAS
*Director of the United States Patent and Trademark Office*